US010478788B2

(12) United States Patent
Jung et al.

(10) Patent No.: US 10,478,788 B2
(45) Date of Patent: Nov. 19, 2019

(54) APPARATUS OF CONTROLLING THE BUBBLE SIZE AND CONTENTS OF BUBBLE, AND THAT METHOD

(71) Applicant: KOREA ATOMIC ENERGY RESEARCH INSTITUTE, Daejeon (KR)

(72) Inventors: In-Ha Jung, Jeollabuk-do (KR); Sung Joo Lee, Gyeonggi-do (KR); Youn Suk Son, Seoul (KR)

(73) Assignee: Korea Atomic Energy Research Institute, Daejeon (KR)

( * ) Notice: Subject to any disclaimer, the term of this patent is extended or adjusted under 35 U.S.C. 154(b) by 457 days.

(21) Appl. No.: 14/991,739

(22) Filed: Jan. 8, 2016

(65) Prior Publication Data

US 2016/0243508 A1 Aug. 25, 2016

(30) Foreign Application Priority Data

Jan. 8, 2015 (KR) ..... 10-2015-0002499

(51) Int. Cl.

| | |
|---|---|
| ***B01F 3/04*** | (2006.01) |
| ***B01F 5/10*** | (2006.01) |
| ***B01F 11/02*** | (2006.01) |
| ***B01F 15/00*** | (2006.01) |
| ***B01F 5/04*** | (2006.01) |
| ***B01F 5/06*** | (2006.01) |

(52) U.S. Cl.

CPC ..... *B01F 3/04503* (2013.01); *B01F 3/04978* (2013.01); *B01F 5/0473* (2013.01); *B01F 5/0478* (2013.01); *B01F 5/061* (2013.01); *B01F 5/065* (2013.01); *B01F 5/0651* (2013.01); *B01F 5/106* (2013.01); *B01F 11/0241* (2013.01); *B01F 15/0022* (2013.01); *B01F 2003/04858* (2013.01); *B01F 2005/0636* (2013.01)

(58) Field of Classification Search

CPC ..... B01F 3/04503
USPC ..... 366/107, 136, 137, 163.2, 174.1, 175.2, 366/336, 340–341

See application file for complete search history.

(56) References Cited

U.S. PATENT DOCUMENTS

| | | | | |
|---|---|---|---|---|
| 2,645,463 A * | 7/1953 | Stearns | B01F 5/0403 | 137/896 |
| 3,119,704 A * | 1/1964 | Harrell | B28C 5/381 | 106/682 |
| 3,450,022 A * | 6/1969 | Engel | A23C 3/037 | 261/75 |
| 3,965,975 A * | 6/1976 | Edmundson | B01F 5/0603 | 165/108 |

(Continued)

FOREIGN PATENT DOCUMENTS

| | | |
|---|---|---|
| JP | 2003170035 A | 6/2003 |
| KR | 2020100010882 U | 11/2010 |

(Continued)

*Primary Examiner* — Abbas Rashid
(74) *Attorney, Agent, or Firm* — McCoy Russell LLP

(57) ABSTRACT

Provided are a device and a method for adjusting the number and size of air bubbles, more particularly, a device and a method for adjusting the number and size of air bubbles, capable of mixing a liquid and gas to form an air bubble mixture or air bubble water (water containing air bubble) and freely adjusting the number and size of air bubbles contained in the formed air bubble mixture to thereby be used in various fields.

9 Claims, 17 Drawing Sheets

(56) References Cited

U.S. PATENT DOCUMENTS 4,207,180 A * 6/1980 Chang ..... B01F 3/0451 210/180
4,207,202 A * 6/1980 Cole, Jr. ..... B01F 3/04446 261/28
4,299,655 A * 11/1981 Skaugen ..... B01F 5/0413 162/343
5,373,212 A * 12/1994 Beau ..... B01F 1/00 310/316.01
5,425,598 A * 6/1995 Pennington ..... B01F 3/04262 405/128.5
5,542,249 A * 8/1996 Heath ..... F01N 1/18 366/337
5,865,537 A * 2/1999 Streiff ..... B01F 3/10 366/137
5,971,371 A * 10/1999 Cheng ..... B01F 3/04262 261/106
6,629,686 B2 * 10/2003 Morse ..... B01D 19/0005 261/79.2
7,261,279 B2 * 8/2007 Boulant ..... B01F 3/04609 261/29
7,445,197 B2 * 11/2008 Ooyachi ..... B01F 3/04269 261/104
9,868,092 B2 * 1/2018 Takahashi ..... B01F 3/04248
2006/0266702 A1 * 11/2006 Chen ..... B01F 3/04503 210/512.1
2014/0369159 A1 * 12/2014 Blendinger ..... B01F 5/0415 366/336
2016/0089679 A1 * 3/2016 Prestes ..... B01F 5/043 209/166
2016/0250604 A1 * 9/2016 Takahashi ..... B01F 5/0659 261/21

FOREIGN PATENT DOCUMENTS

KR 101051367 B1 7/2011
KR 1020120029259 A 3/2012
KR 101231808 B1 2/2013
KR 101241760 B1 3/2013
KR 101370229 B1 3/2014

* cited by examiner

FIG. 5
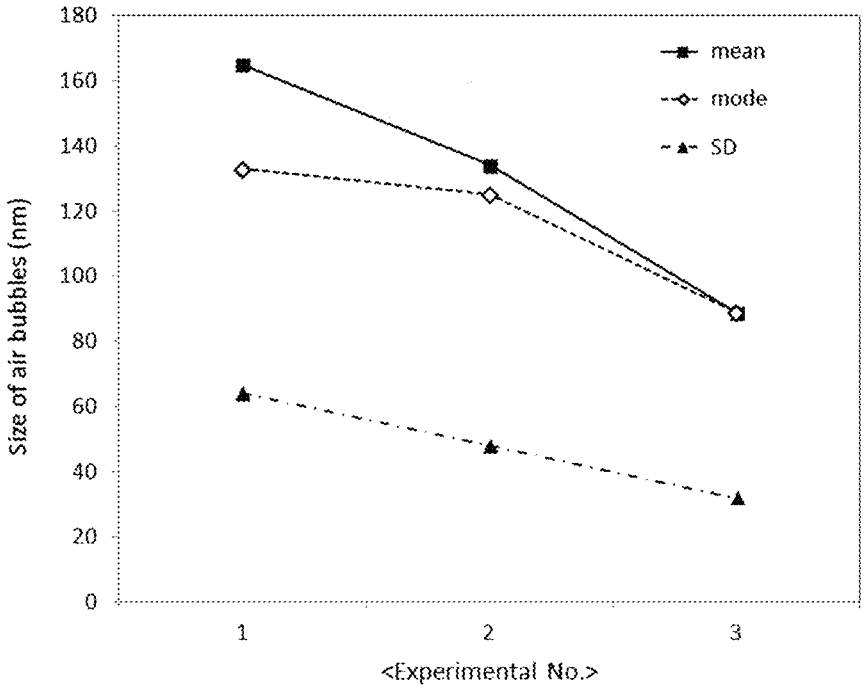
<Results of mean, mode, and SD>
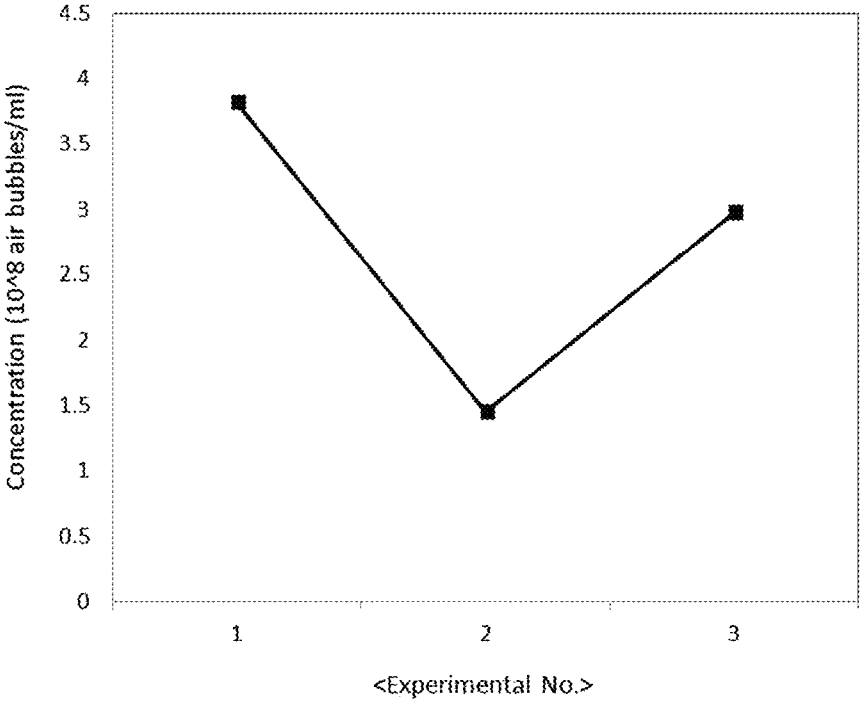
<Results of the number of the bubbles>

FIG. 7
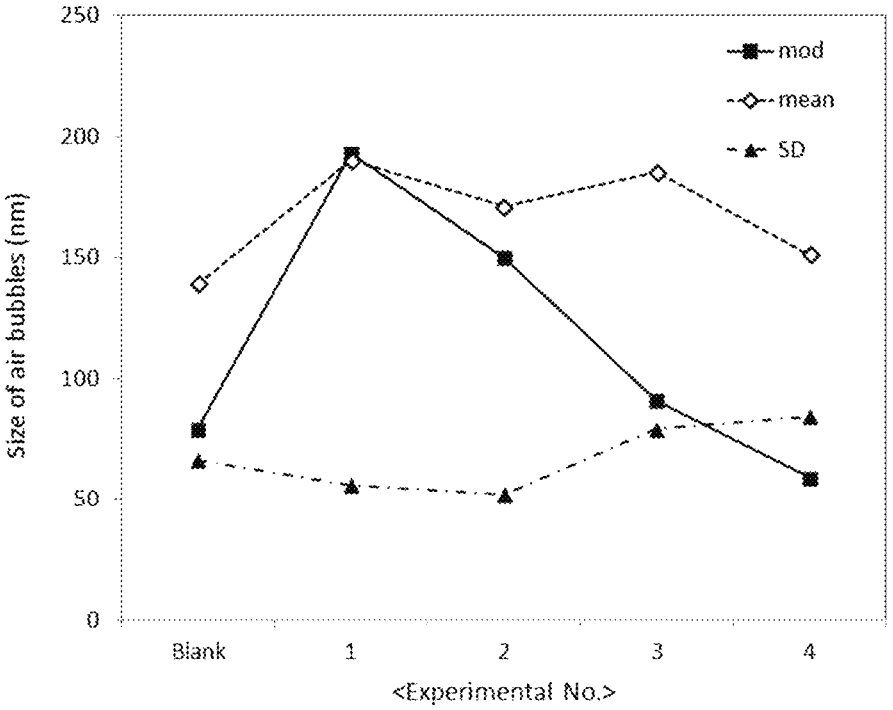
<Results of mean, mode, and SD>
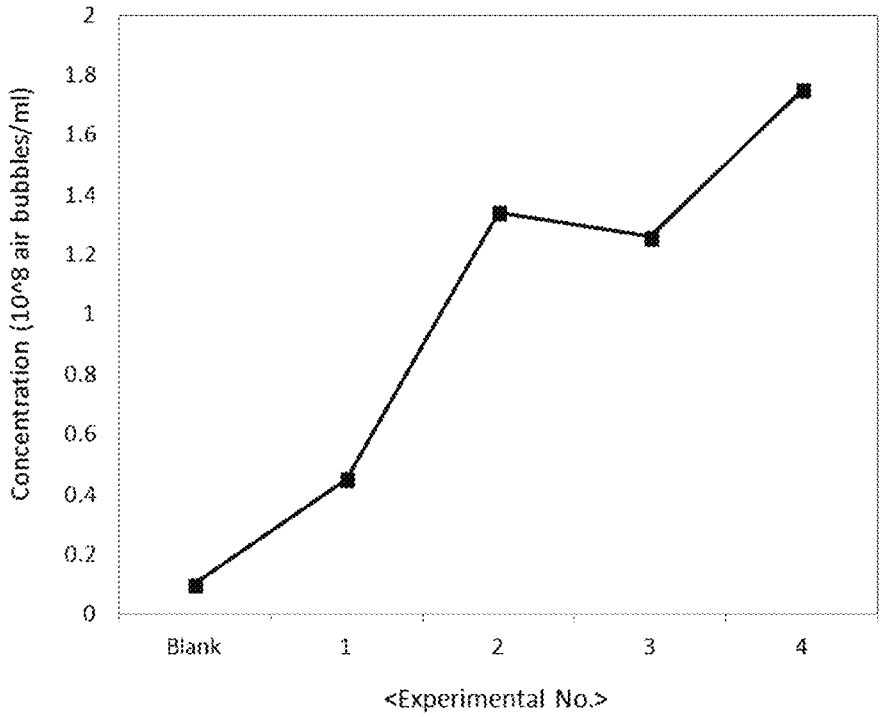
<Results of the number of the bubbles>

FIG. 8
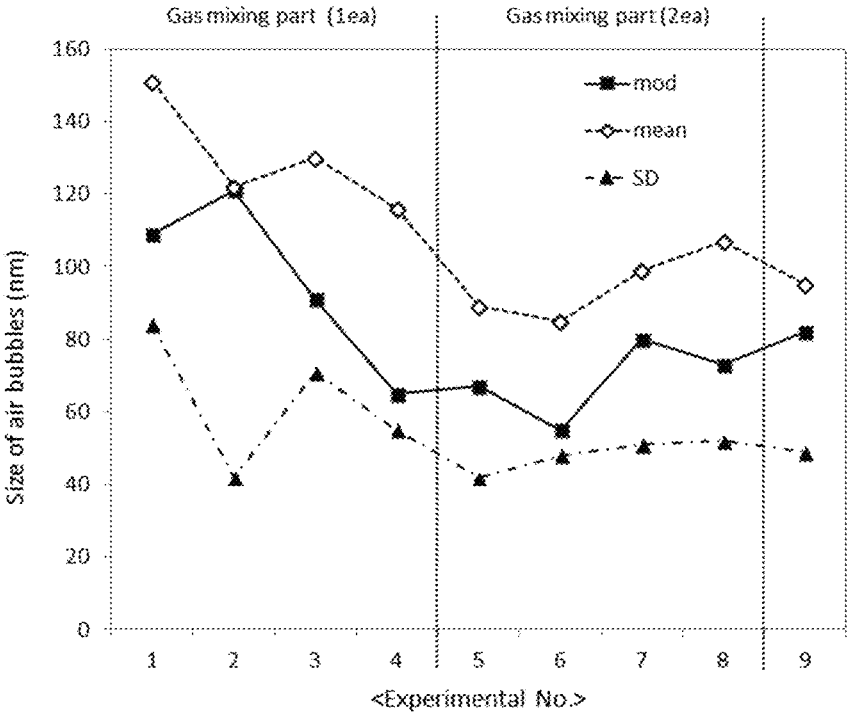
<Results of mean, mode, and SD>
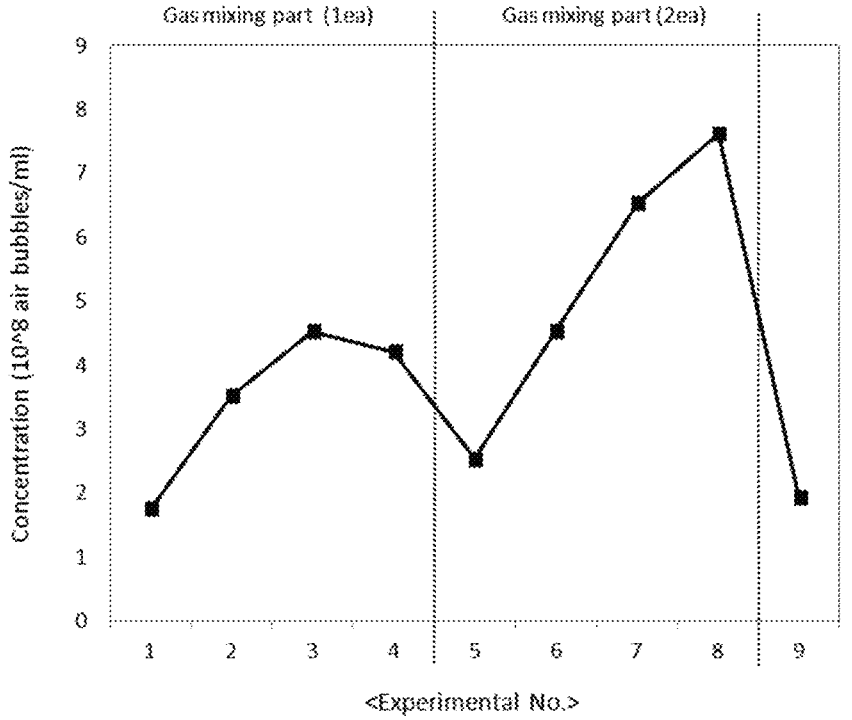
<Results of the number of the bubbles>

Change in Population of aspergillus strain depending on storage temperature and storage time of Makgeolli and the kind of bubbling gas
(a) Storage temperature: 4 ℃, (b) Storage temperature: 20 ℃

Comparison of chlorophyll content depending on culture solution
(general water, oxygen water, and hydrogen water)

Comparison of growth rate of whangtosongi mushroom
(The higher mycellium concentration, the whiter as illustrated in photograph)

FIG. 14

| **Inoculated Strain**<br>Bacteria : *Pseudomonas aeruginosa*, *Escherichia coli*, *Staphylococcus aureus*<br>Fungi : *Aspergillus niger*, *Candida albicans* | 3 days (Dec. 22) | | 1 week (Dec. 27) | | 2 weeks (Jan. 3) | | 3 weeks (Jan. 10) | | 4 weeks (Jan. 17) | |
|---|---|---|---|---|---|---|---|---|---|---|
| | Fungi | Bacteria | Fungi | Bacteria | Fungi | Bacteria | Fungi | Bacteria | Fungi | Bacteria |
| Oxygen water(water purifier) | $1.2 \times 10^5$ | $2.6 \times 10^7$ | $3.9 \times 10^4$ | $2.4 \times 10^6$ | $1.8 \times 10^4$ | U.C | $2.4 \times 10^3$ | U.C | $2.0 \times 10^5$ | $1.3 \times 10^7$ |
| Hydrogen water(water purifier) | $2.0 \times 10^4$ | $4.4 \times 10^6$ | $3.4 \times 10^4$ | $2.4 \times 10^6$ | $4.1 \times 10^3$ | U.C | $2.0 \times 10^4$ | U.C | $8.0 \times 10^5$ | $9.8 \times 10^6$ |
| Hydrogen water(distilled water) | $2.0 \times 10^4$ | $1.2 \times 10^7$ | $2.0 \times 10^7$ | $1.7 \times 10^7$ | $1.0 \times 10^4$ | U.C | $2.0 \times 10^7$ | U.C | $1.0 \times 10^6$ | $1.2 \times 10^7$ |

o Inculation amount(CFU/g) - Fungi : $2.0 \times 10^5$ , Bacteria : $6.68 \times 10^5$ , Inoculation date : 2010.12.20.

o Judgement criteria(Cosmetic) : Both of the following conditions A and B are satisfied

- A. 99.9% or more of bacteria and 90% or more of fungi were decreased at 7th day after inoculation
- B. The numbers of bacteria and fungi detected at 7th day were not increased up to 14 days and 28 days after inoculation

* U.C : UNCOUNTABLE

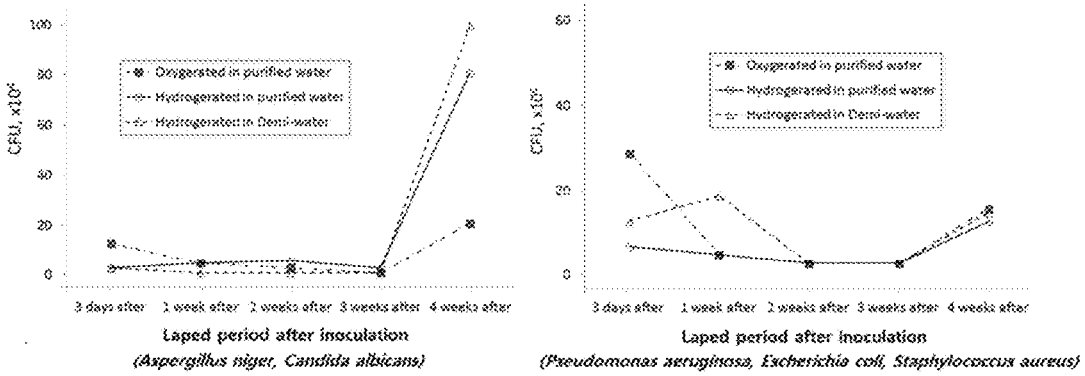

Sterilization effect of oxygen water and hydrogen water on fungi (left) and general bacteria (right)

FIG. 15
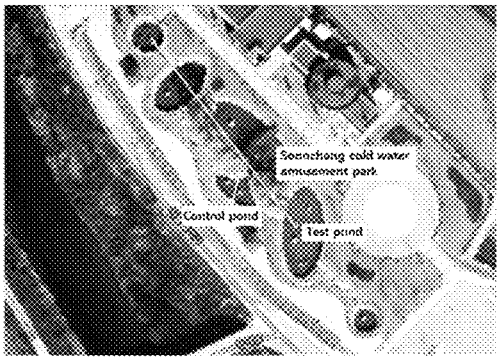
Complete view of test place in Soonchang cold water amusement park
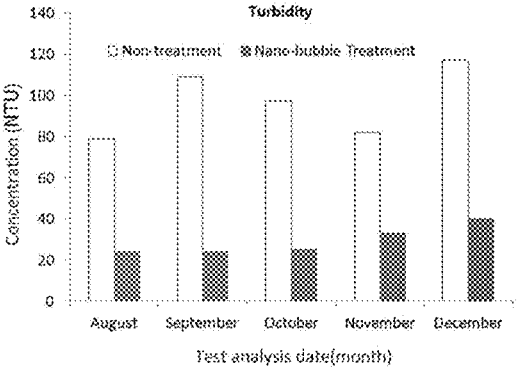
Turbidity in control pond and test pond
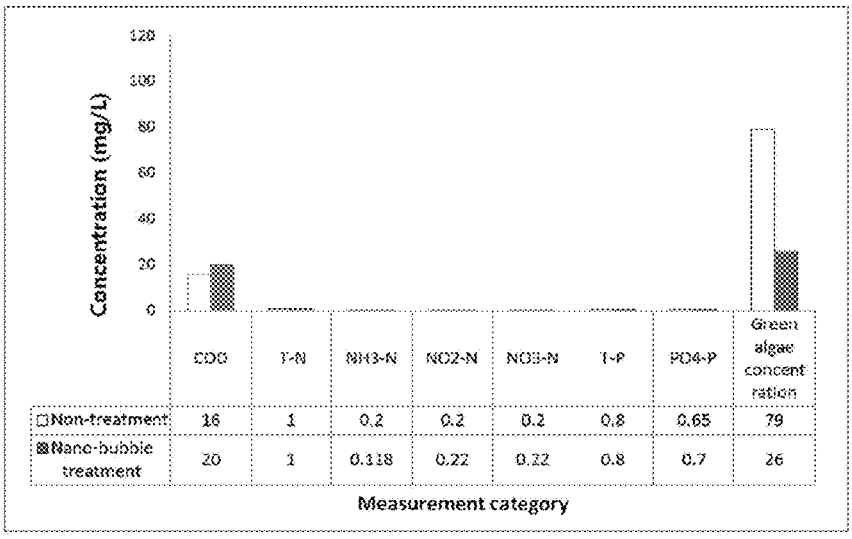
| | COD | T-N | NH3-N | NO2-N | NO3-N | T-P | PO4-P | Green algae concentration |
|---|---|---|---|---|---|---|---|---|
| Non-treatment | 16 | 1 | 0.2 | 0.2 | 0.2 | 0.8 | 0.65 | 79 |
| Nano-bubble treatment | 20 | 1 | 0.118 | 0.22 | 0.22 | 0.8 | 0.7 | 26 |
Comparison of water quality in control pond and test pond

FIG. 16

NANOSIGHT

Nanoparticle Tracking Analysis (NTA) version 2.3 Build 0025

ANALYSIS REPORT

Sample:
Date/Time of Capture:
Video File: a.avi analysis no: 002
Operator:
Comments:

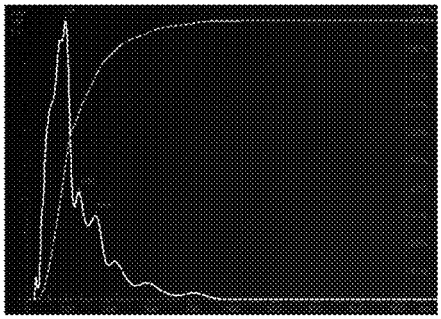

Particle Size / Concentration

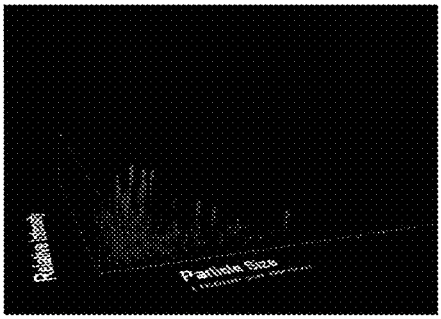

Particle Size / Relative Intensity 3D plot

| Bin Centre (nm) | Concentration (E8 particles/ml) | Percentile Undersize (%) |
|---|---|---|
| 10 | 0.027 | 0.094 |
| 30 | 20.081 | 2.596 |
| 50 | 93.377 | 14.649 |
| 70 | 126.400 | 30.985 |
| 90 | 157.182 | 51.254 |
| 110 | 93.354 | 63.304 |
| 130 | 60.285 | 71.086 |
| 150 | 45.841 | 77.003 |
| 170 | 46.139 | 83.217 |
| 190 | 25.550 | 86.902 |
| 210 | 21.976 | 89.739 |
| 230 | 19.151 | 92.211 |
| 250 | 11.087 | 93.642 |
| 270 | 8.461 | 94.734 |
| 290 | 9.703 | 95.987 |
| 310 | 8.402 | 97.071 |
| 330 | 5.346 | 97.761 |
| 350 | 3.121 | 98.164 |
| 370 | 2.559 | 98.494 |
| 390 | 3.337 | 98.925 |
| 410 | 3.763 | 99.411 |
| 430 | 2.807 | 99.773 |
| 450 | 1.311 | 99.942 |
| 470 | 0.375 | 99.991 |
| 490 | 0.065 | 99.999 |
| 510 | 0.007 | 100.000 |
| 530 | 0.000 | 100.000 |
| 550 | 0.000 | 100.000 |
| 570 | 0.000 | 100.000 |
| 590 | 0.000 | 100.000 |
| 610 | 0.000 | 100.000 |
| 630 | 0.000 | 100.000 |
| 650 | 0.000 | 100.000 |
| 670 | 0.000 | 100.000 |
| 690 | 0.000 | 100.000 |

| Bin Centre (nm) | Concentration (E8 particles/ml) | Percentile Undersize (%) |
|---|---|---|
| 710 | 0.000 | 100.000 |
| 730 | 0.000 | 100.000 |
| 750 | 0.000 | 100.000 |
| 770 | 0.000 | 100.000 |
| 790 | 0.000 | 100.000 |
| 810 | 0.000 | 100.000 |
| 830 | 0.000 | 100.000 |
| 850 | 0.000 | 100.000 |
| 870 | 0.000 | 100.000 |
| 890 | 0.000 | 100.000 |
| 910 | 0.000 | 100.000 |
| 930 | 0.000 | 100.000 |
| 950 | 0.000 | 100.000 |
| 970 | 0.000 | 100.000 |
| 990 | 0.000 | 100.000 |
| 1000-2000 | 0.000 | 100.000 |

Results

| | |
|---|---|
| Mean: | 123 nm |
| Mode: | 96 nm |
| SD: | 74 nm |
| D10: | 53 nm |
| D50: | 98 nm |
| D90: | 221 nm |
| User Lines: | 0 nm, 0 nm |
| Concentration: | 7.75 E8 particles/ml |
| Completed Tracks: | 301 |

Measurement Conditions

| | |
|---|---|
| Temperature: | 22.25 °C |
| Viscosity: | 0.95 cP |
| Frames Per Second: | 24.98 |
| Measurement Time: | 10 of 10 s |
| Drift Velocity: | 829 nm/s |
| Camera Shutter: | 25 ms |

Analysis Conditions

| | |
|---|---|
| Blur: | Auto |
| Detection Threshold: | 4 Multi |
| Min Track Length: | Auto |
| Min Expected Size: | Auto |

FIG. 17

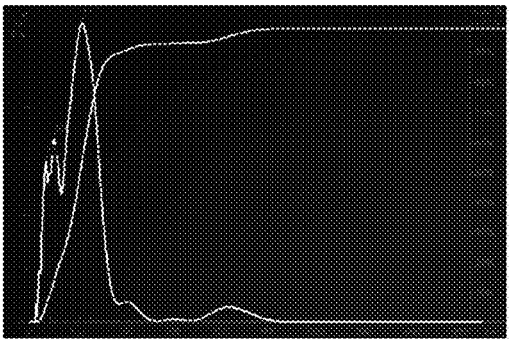

Particle Size / Concentration

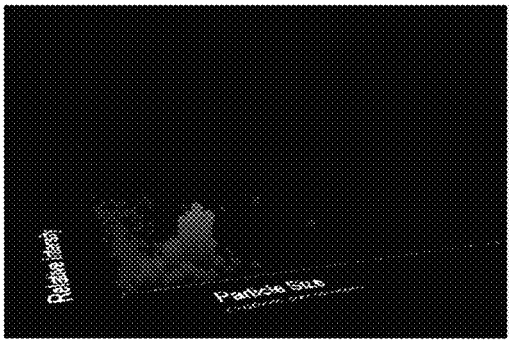

Particle Size / Relative Intensity 3D plot

| Bin Centre (nm) | Concentration E6 particles / ml | Percentile Undersize |
|---|---|---|
| 10 | 1.733 | 0.00% |
| 30 | 40.032 | 2.88% |
| 50 | 61.205 | 12.54% |
| 70 | 55.836 | 22.58% |
| 90 | 86.557 | 34.82% |
| 110 | 108.455 | 52.04% |
| 130 | 96.384 | 70.14% |
| 150 | 54.940 | 83.25% |
| 170 | 17.562 | 88.52% |
| 190 | 7.240 | 90.11% |
| 210 | 7.242 | 91.35% |
| 230 | 4.522 | 92.40% |
| 250 | 1.467 | 92.84% |
| 270 | 0.503 | 92.96% |
| 290 | 0.611 | 93.07% |
| 310 | 0.965 | 93.28% |
| 330 | 0.940 | 93.37% |
| 350 | 0.811 | 93.47% |
| 370 | 2.189 | 93.72% |
| 390 | 4.151 | 94.28% |
| 410 | 5.417 | 95.14% |
| 430 | 5.411 | 96.09% |
| 450 | 4.344 | 96.93% |
| 470 | 2.824 | 97.53% |
| 490 | 1.468 | 97.88% |
| 510 | 0.687 | 98.04% |

| Bin Centre (nm) | Concentration E6 particles / ml | Percentile Undersize |
|---|---|---|
| 530 | 0.184 | 98.09% |
| 550 | 0.040 | 98.11% |
| 570 | 0.000 | 98.11% |
| 590 | 0.000 | 98.11% |
| 610 | 0.000 | 98.11% |
| 630 | 0.000 | 98.11% |
| 650 | 0.000 | 98.11% |
| 670 | 0.000 | 98.11% |
| 690 | 0.000 | 98.11% |
| 710 | 0.000 | 98.11% |
| 730 | 0.000 | 98.11% |
| 750 | 0.000 | 98.11% |
| 770 | 0.000 | 98.11% |
| 790 | 0.000 | 98.11% |
| 810 | 0.000 | 98.11% |
| 830 | 0.000 | 98.11% |
| 850 | 0.000 | 98.11% |
| 870 | 0.000 | 98.11% |
| 890 | 0.000 | 98.11% |
| 910 | 0.000 | 98.11% |
| 930 | 0.000 | 98.11% |
| 950 | 0.000 | 98.11% |
| 970 | 0.000 | 98.11% |
| 990 | 0.000 | 98.11% |
| 1000-2000 | 11.053 | 100.00% |
| | | |

Results
Mean: 141 nm
Mode: 112 nm
SD: 181 nm
D10: 45 nm
D50: 107 nm
D90: 188 nm
User Lines: 0, 0 nm
Concentration: 5.85 x 10^6 particles/ml

Measurement Conditions

Temperature: 26.00 °C
Viscosity: 0.87 cP
Frames Per Second: 30.00
Measurement Time: 60 of 60 seconds
Drift Velocity: 1040 nm/s

Analysis Conditions

Brightness: -6
Gain: 6.00
Blur: 5x5
Detection Threshold: Auto
Max Blob Size (pixel area): 3000
Min Track Length: Auto
Min Expected Size: 50 nm

APPARATUS OF CONTROLLING THE BUBBLE SIZE AND CONTENTS OF BUBBLE, AND THAT METHOD

CROSS REFERENCE TO RELATED APPLICATIONS

This application claims priority under 35 U.S.C. § 119 to Korean Patent Application No. 10-2015-002499, filed on Jan. 8, 2015, in the Korean Intellectual Property Office, the disclosure of which is incorporated herein by reference in its entirety.

TECHNICAL FIELD

The following disclosure relates to a device and a method for adjusting the number and size of air bubbles, capable of being easily used in various industrial fields requiring the predetermined number and size of air bubbles by adjusting the number and size of air bubbles so as to be suitable for purpose with one apparatus, in an apparatus and a method of generating air bubbles for allowing air bubbles having nano and micro sizes to be contained in a liquid.

BACKGROUND

Recently, a technology of dissolving gas at a high concentration, or allowing gas to remain as air bubbles, be destroyed, or be floated in a liquid has been variously applied in several industrial fields including a food industry field.

Particularly, in a food field, gas such as carbon dioxide, or the like, is dissolved or allowed to remain in drinking water to thereby be utilized as a functional drink, or the like, in a semiconductor manufacturing field, air bubbles have been used to wash a surface of a semiconductor by allowing the air bubbles air bubbled in a liquid to be destroyed on an etching surface of the semiconductor, and in an environmental field, air bubbles having levitation power have been utilized in order to remove floating materials in waste water.

However, since the air bubbles used in various fields as described above should be manufactured so that air bubbles having a size suitable for purpose in each of the fields are contained, and the number of contained air bubbles also is suitable for the purpose, a different apparatus and method of generating air bubbles have been used in each of the field.

FIG. 1 illustrates an apparatus of generating air bubbles using a hydrodynamic method, which is a representative commercialized means among the existing apparatus of generating air bubbles.

Referring to FIG. 1, the apparatus of generating air bubbles is configured to include an underwater motor connected to an electric cord supplied with power from the land; an impeller formed at an output rotation axis of the underwater motor in a radial shape when being viewed from a bottom surface so as to finely crush air bubbles having a large diameter, and including a plurality of rotating blades having a jaw and formed in a saw-teeth shape; an impeller protection member including a partition wall provided with slits at a lower end of the underwater motor and extended downwardly so as to enclose the impeller, and a single-side filter having a cup shape and covered on a lower end of the partition wall; and a gas injector including a gas injection hose supplied with compression air from a compressor on the ground and connected to the underwater motor and a gas injection hose connected to a distal end of the gas injection so that a spray nozzle is positioned at the center of the impeller.

In the apparatus of generating air bubbles according to the related art as described above, fine air bubbles were formed in water by finely crushing oxygen introduced from the outside in a liquid using the impeller rotating at a high speed, but in order to rotate the rotating blades or impeller as described above at the high speed, a large amount of electrical energy is continuously consumed, and there is a problem in working safety.

Further, structures of water and oxygen molecules may be destroyed due to high-speed rotation of the impeller, and there are disadvantages such as mixing of metal particles due to abrasion of the rotating blade, a temperature rise of a fluid due to friction between the liquid and the impeller and heat of a driving motor, alternation of the fluid caused by the temperature rise, a decrease in the number of remaining air bubbles, and the like.

As a result, the apparatus of generating air bubble according to the related art as described above may be used only in some environmental field, for example, a case of floating the floating materials in waste water treatment, but uses of the apparatus of generating air bubbles are restrictive in fields requiring hygiene cleanliness such as a drink water field, a semiconductor washing field, or the like.

A necessity for a device and a method for adjusting the number and size of air bubbles, not causing a change in molecular structure of water or gas, which is the disadvantage of the apparatus of generating air bubbles according to the related art as described above, and not causing a phenomenon that foreign materials are contained, that is, not using the high-speed impeller has been increased.

SUMMARY

An embodiment of the present invention is directed to providing a device and a method for adjusting the number and size of air bubbles capable of mixing a liquid and gas to form an air bubble mixture or air bubble water (water containing air bubble) and freely adjusting the number and size of air bubbles contained in the formed air bubble mixture to thereby be used in various fields.

In one general aspect, a device for adjusting the number and size of air bubbles includes: a gas mixing part in which a liquid and gas are mixed with each other to form an air bubble mixture or air bubble water; an air bubble fining part coupled to a lower end of the gas mixing part and including a plurality of first protrusions formed on an inner surface thereof so that the air bubble mixture introduced from the air bubble mixing part collides therewith; and an expanded pipe part formed on a lower end of the air bubble fining part and dispersing and discharging the air bubble mixture, wherein a length of each of the parts is extended or shortened, and a flow rate, a flow speed, and the like of the gas and the liquid is adjusted and circulated.

The air bubble fining part may further include an air bubble crushing bar at the center thereof in an axial direction, wherein an outer surface of the air bubble crushing bar may be provided with a plurality of second protrusions, the second protrusion being alternated with the first protrusion.

The device for adjusting the number and size of air bubbles may further include: a liquid introduction part controlling a flow rate and a flow speed of the liquid introduced into the gas mixing part; and a gas introduction part controlling a flow rate and a flow speed of the gas introduced into the gas mixing part, wherein the gas introduction part is provided with a first spray nozzle supplying the gas to the liquid introduced into the gas mixing part.

The device for adjusting the number and size of air bubbles may further include: a storage tank in which the air bubble mixture discharged from the expanded pipe part is stored and a measurement sensor measuring the number and size of air bubbles contained in the stored air bubble mixture is provided; a pump moving the air bubble mixture stored in the storage tank to the gas mixing part; and a control part linked with the measurement sensor to drive the pump.

The air bubble fining part may have a structure in which a plurality of units may be coupled to each other or removed in the axial direction in order to adjust the number and size of the air bubbles.

The air bubble fining part and the expanded pipe part may further include ultrasonic wave generating parts emitting ultrasonic waves to the air bubble mixture flowing therein, respectively.

A diameter of the gas mixing part may be 2 to 3 times that of a liquid supply pipe through which the liquid is introduced into the gas mixing part.

A lower portion of the gas mixing part connected to the air bubble fining part may be provided with an acceleration part, the acceleration part having a tapered shape in which a width of an inner channel is decreased from an upper portion thereof toward a lower portion thereof so as to increase the flow speed of the liquid.

The expanded pipe part may have a tapered shape in which an inner channel is widened from an upper portion thereof coupled to the air bubble fining part toward a lower portion thereof through which the air bubble mixture is discharged.

In the first spray nozzle, one or two or more holes may be formed, and the flow rate and the flow speed of the gas introduced into the gas mixing part may be controlled by adjusting the number of holes.

In another general aspect, a method for adjusting the number and size of air bubbles may include: an air bubble mixture forming step of mixing a liquid supplied from the upside through a pump and gas to form an air bubble mixture; an air bubble controlling step of introducing the air bubble mixture into an air bubble fining part including protrusion formed on an inner surface thereof to control the number and size of air bubbles contained in the air bubble mixture; and an air bubble measuring step of measuring the number and size of the air bubbles contained in the air bubble mixture discharged from the air bubble fining part.

The method for adjusting the number and size of air bubbles may further include, after the air bubble measuring step, an air bubble mixture circulating step of replacing the liquid with the air bubble mixture discharged from the air bubble fining part to repeat the air bubble mixture forming step, the air bubble controlling step, and the air bubble measuring step when the number and size of the air bubbles contained in the air bubble mixture do not reach the desired values.

In the control step, the number and size of the air bubbles contained in the air bubble mixture may be adjusted by adjusting a length of the air bubble fining part.

BRIEF DESCRIPTION OF THE DRAWINGS

FIG. 5 illustrates experimental data of air bubble water prepared using the device for adjusting the number and size of air bubbles (at the time of changing the number or size of holes of a first spray nozzle).

FIG. 7 illustrates experimental data of air bubble water prepared using the device for adjusting the number and size of air bubbles (at the time of changing a length of the air bubble fining part).

FIG. 8 illustrates experimental data of air bubble water prepared using the device for adjusting the number and size of air bubbles (at the time of changing a length of the gas mixing part).

FIG. 14 illustrates Application Example 4 using the device for adjusting the number and size of air bubbles (sterilization effect of oxygen water, and hydrogen water on fungi and general bacteria).

FIGS. 15 and 16 illustrate Application Example 5 using the device for adjusting the number and size of air bubbles (influence on green algae removal and ecological environment).

FIGS. 17 to 18 illustrate Application Example 6 using the device for adjusting the number and size of air bubbles (influence on oxygen bubble mixed fuel oil and hydrogen bubble mixed fuel oil on degree of combustion).

DETAILED DESCRIPTION OF MAIN ELEMENTS

Figure 1:
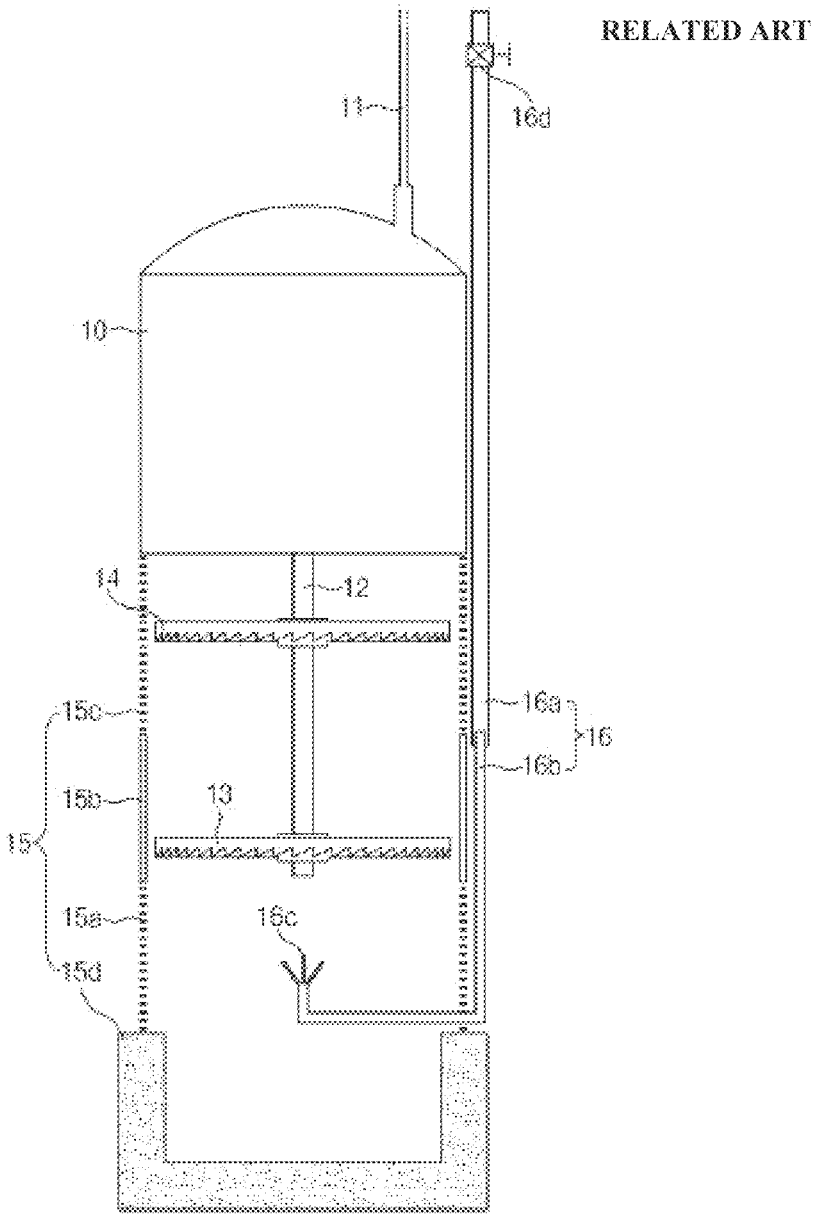
FIG. 1 is a cross-sectional view illustrating an apparatus of generating air bubbles according to the related art.

1: LIQUID
2: GAS
3: AIR BUBBLE MIXTURE
100: GAS MIXING PART
101: ACCELERATION PART
110: LIQUID INTRODUCTION PART
111: VALVE
120: GAS INTRODUCTION PART
121: FIRST SPRAY NOZZLE
200: AIR BUBBLE FINING PART
200A: UNIT

210: FIRST PROTRUSION
220: AIR BUBBLE CRUSHING BAR
221: SECOND PROTRUSION
300: EXPANDED PIPE PART
230, 310: ULTRASONIC WAVE GENERATING PART
400: STORAGE TANK
410: MEASUREMENT SENSOR
500: PUMP
600: CONTROL PART
700: PIPE

DETAILED DESCRIPTION OF EMBODIMENTS

Hereinafter, a device and a method for adjusting the number and size of air bubbles according to the present invention will be described in detail with reference to the accompanying drawings.

Further, gas 2 contained in an air bubble mixture 3 is defined as "air bubble", and the device and the method for adjusting the number and size of air bubbles according to the present invention will be described.

The present invention relates to a device and a method for adjusting the number and size of air bubbles 2 contained in the air bubble mixture 3 so as to be suitable for applicable purpose in the case of mixing the gas 2 with a liquid 1 to prepare the air bubble mixture or air bubble water 3.

Figure 2:
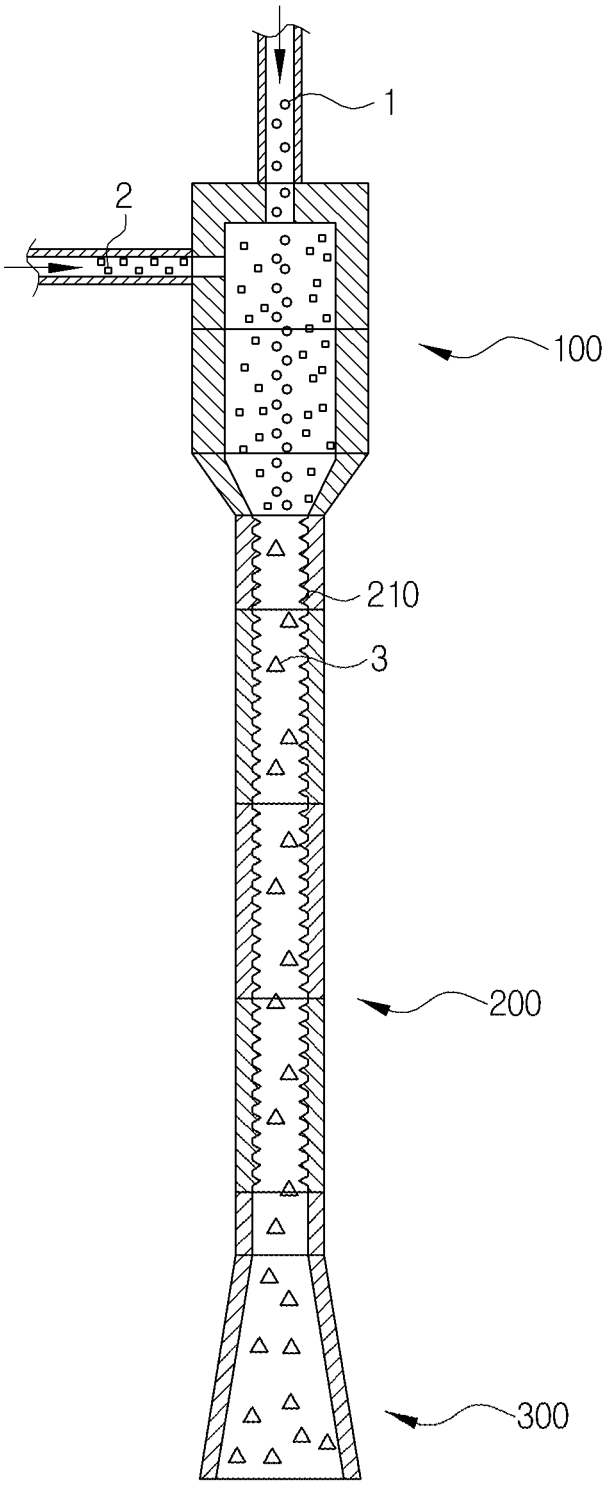
FIG. 2 is a conceptual view illustrating a device for adjusting the number and size of air bubbles.

Referring to FIG. 2, the device for adjusting the number and size of air bubbles includes: a gas mixing part 100 in which a liquid 1 introduced from a pump and gas 2 are mixed with each other to form an air bubble mixture 3; an air bubble fining part 200 coupled to a lower end of the gas mixing part 100 and including a plurality of first protrusions 210 formed on an inner surface thereof so that the air bubble mixture 3 introduced from the air bubble mixing part 100 collides therewith; and an expanded pipe part 300 formed on a lower end of the air bubble fining part 200 and dispersing and discharging the air bubble mixture 3.

In detail, the gas mixing part 100 adjusts a mixing ratio of the gas 2 introduced into the liquid 1 by adjusting flow rates and flow speeds of the liquid 1 and the gas 2, the bubbling fining part 200 controls the number and size of air bubbles contained in the air bubble mixture 3 in which the liquid 1 and the gas 2 are mixed by controlling a shape or a length and a flow speed of the air bubble fining part 200, and the expanded pipe part 300 disperses the discharged air bubble mixture 3.

Therefore, since in the device and the method for adjusting the number and size of air bubbles according to the present invention, air bubbles of several ten nanometers to several hundred micrometers may be manufactured using one device so as to have constant size distribution, the device and the method for adjusting the number and size of air bubbles may be efficiently and economically utilized in industrial fields such as a food industry, an engineering industry, an environmental industry, a bio industry, a medical industry, and the like.

Hereinafter, the gas mixing part 100 and the air bubble fining part 200 controlling a total amount, the number, and the size of air bubbles contained in the air bubble mixture 3 will be described with reference to the accompanying drawings.

Figure 3:
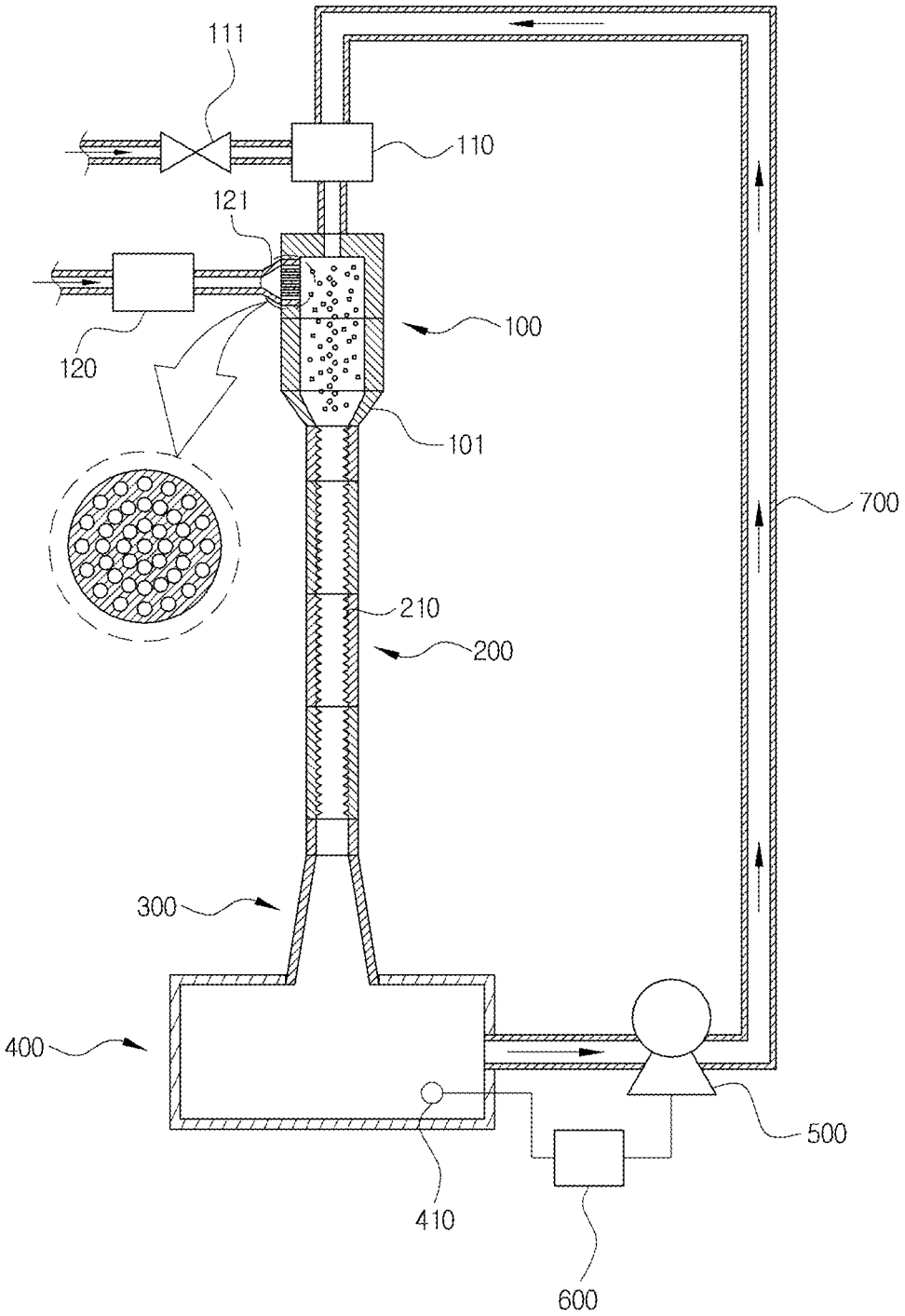
FIG. 3 is a conceptual view illustrating the device for adjusting the number and size of air bubbles (at the time of circulation of an air bubble mixture or air bubble water).

Referring to FIG. 3, the device for adjusting the number and size of air bubbles according to the present invention may further include a liquid introduction part 110 controlling the flow rate and the flow speed of the liquid 1 introduced into the gas mixing part 100 and a gas introduction part 120 controlling the flow rate and the flow speed of the gas 2 introduced into the gas mixing part 100.

In detail, a ratio of the liquid 1 and the gas 2 and inflow speeds thereof to be required are changed depending on characteristics of the liquid 1 and the gas 2 to be mixed with each other and the number and size of air bubbles contained in the air bubble mixture 3 to be formed. That is, the flow rates and flow speeds of the liquid 1 and the gas 2 introduced into the gas mixing part 100 are controlled in the liquid introduction part 110 and the gas introduction part 120 so as to be suitable for characteristics of each of the desired air bubble mixture 3.

In this case, it is recommended that a diameter of the gas mixing part 100 is 2 to 3 times a diameter of a liquid supply pipe corresponding to a path through which the liquid 1 moves from the liquid introduction part 110 to the gas mixing part 100, such that the liquid 1 and the gas 2 introduced into the gas mixing part 100 are efficiently mixed with each other.

In addition, since the larger the volume of the gas mixing part 100, the larger the number of air bubbles, the gas mixing part 100 may adjust the number and size of air bubbles by adjusting a height thereof depending on the characteristics of the desired air bubble mixture 3.

That is, it is preferable that the number and size of air bubbles in the air bubble mixture 3 are adjusted by controlling the diameter or height of the gas mixing part 100 depending on the characteristics of the desired air bubble mixture 3 without limiting a volume of the gas mixing part 100.

In addition, generally, the gas mixing part 100 is formed in a cylindrical shape so that the liquid 1 and the gas 2 may be uniformly mixed with each other, but may be formed in a shape similar to a cone of which a diameter is decreased in a downward direction.

That is, the gas mixing part 100 is formed in a shape in which a diameter thereof is decreased in a downward direction so as to increase movement speeds of the liquid 1, the gas 2, and the air bubble mixture 3, thereby making it possible to increase mixing efficiency of the liquid 1 and the gas 2.

However, the gas mixing part 100 of the present invention may have various shapes such as a triangular pillar shape or triangular pyramid shape of which a cross-section is a triangle, or the like, depending on the number and size of air bubbles in the desired air bubble mixture 3, in addition to the cylindrical shape or the cone shape of which a cross section is a circle.

Further, the air bubble mixture 3 formed in the gas mixing part 100 may collide with the first protrusion 210 formed on the inner surface of the air bubble fining part 200 to thereby drop, such that the size of air bubbles 2 contained in the air bubble mixture 3 is decreased. In this case, a degree of decreasing the size of air bubbles 2 contained in the air bubble mixture 3 is controlled by a speed of the air bubble mixture 3 introduced into the air bubble fining part 200.

Therefore, a change of gas 2 contained in the air bubble mixture 3 may be controlled by controlling the flow rates and the flow speeds of the liquid 1 and the gas 2 to control the speed of the air bubble mixture 3 introduced into the air bubble mixture part 200.

In this case, the speeds of the liquid 1 and the gas 2 discharged from the liquid introduction part 110 and the gas introduction part 120 and introduced into the air bubble fining part 200 are changed as illustrated in the following [Table 1] in a device manufactured as an example in order to implement the present invention.

TABLE 1

| Condition | Flow Rate (Q; l/min) | Diameter (mm) | The number of holes of first spray nozzle | Speed (V; m/s) |
|---|---|---|---|---|
| 1. Flow speed of gas discharged from gas introduction part | 28 | 20 | 1 | 1.486 |
| 2. Flow speed of gas introduced into air bubble fining part | 28 | 24 | 1 | 1.032 |
| 3. Flow speed of liquid discharged from liquid introduction part | 40 | 20 | 1 | 2.123 |
| 4. Flow speed of liquid introduced into air bubble fining part | 40 | 24 | 1 | 1.474 |

<Speed of Liquid and Gas>

In addition, in order to smoothly discharge the liquid 1 and the gas 2 mixed with each other in the gas mixing part 100 to thereby be introduced into the air bubble fining part 200 and maximize the mixing of the liquid and the gas by a vortex, an acceleration part 101 may be formed at the lower end of the gas mixing part 100 at which the gas mixing part 100 and the air bubble fining part 200 are connected to each other.

In detail, the acceleration part 101 may have a tapered shape in which a cross section thereof is decreased from an upper portion thereof toward a lower portion thereof, and be formed to have a gradient of about 60 to 80 degrees, such that the air bubble mixture 3 may rapidly pass therethrough without resistance to thereby be introduced into the air bubble fining part 200.

Further, since the gas mixing part 100 is composed of a plurality of units coupled to each other in an axial direction, a length of the gas mixing part in which the gas 2 and the liquid 1 are mixed with each other and the speeds of the liquid 1 and the gas 2 introduced into the air bubble fining part 200 may be controlled by adjusting the number of units to control a total length of the gas mixing part.

In addition, it is possible to control the number and size of air bubbles contained in the air bubble mixture 3 by adjusting the number and size of holes of a first spray nozzle 121 provided in a path of the gas 2 introduced into the gas mixing part 100.

Figure 4:
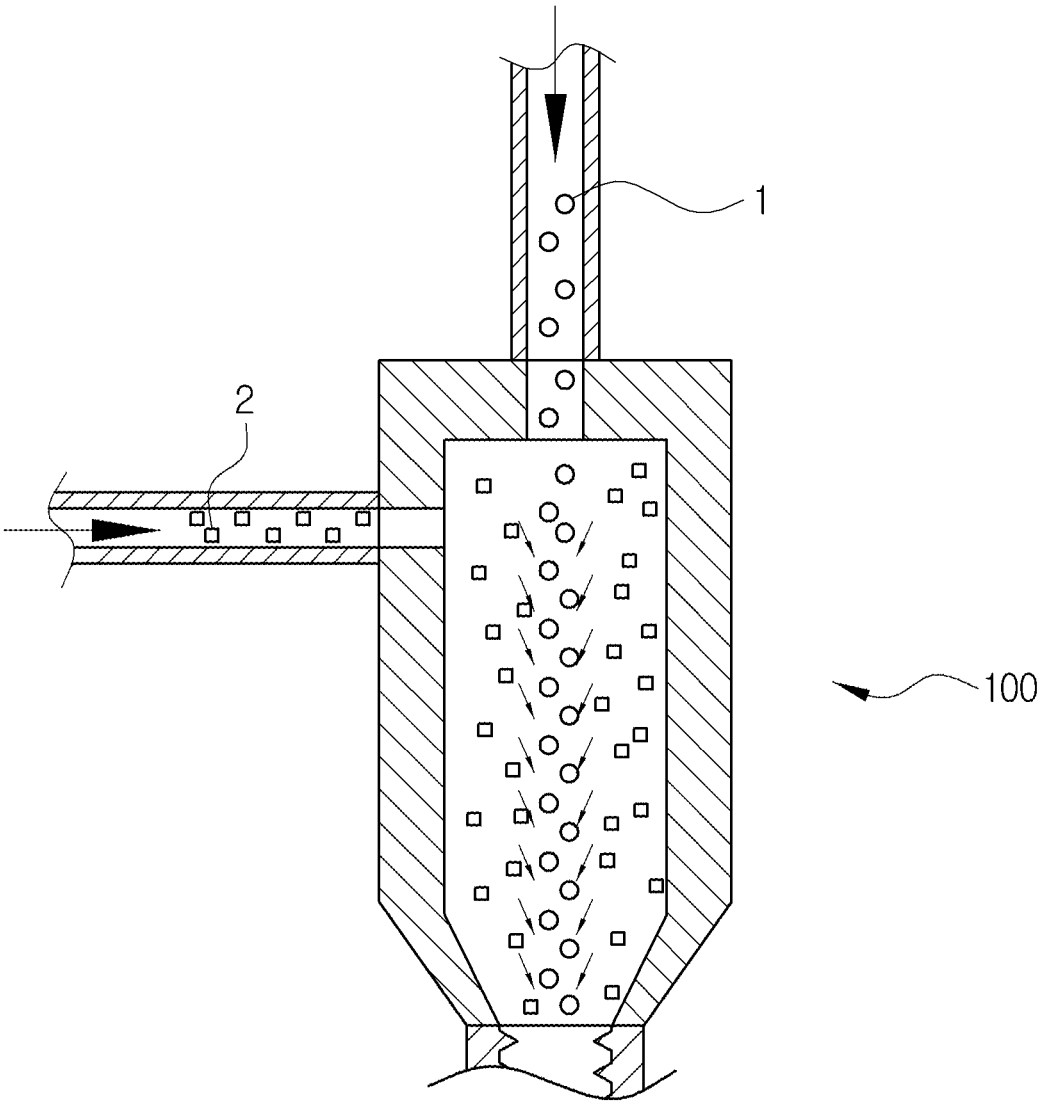
FIG. 4 is a conceptual view illustrating a gas mixing part of the device for adjusting the number and size of air bubbles.

More specifically, in the case of increasing the speed of the gas 2 contacting the liquid 1 introduced from the liquid introduction part 110 into the air bubble fining part 200 through the gas mixing part 100, the gas 2 may be forcibly introduced into the liquid 1, such that the size of the air bubbles 2 contained in the air bubble mixture 3 is increased, and in the case of increasing the number of holes formed in the first spray nozzle 121 to decrease the speed of the gas 2, since a speed of ambient gas 2 sucked into the liquid 1 introduced into the air bubble fining part 200 is decreased as illustrated in FIG. 4, the size of the air bubbles 2 contained in the air bubble mixture 3 is decreased.

In this case, in the device manufactured according to the present invention by way of example, a speed of gas 2 introduced into a gas mixing part 100 depending on the number of holes formed in a first spray nozzle 121 is changed as illustrated in the following [Table 2].

TABLE 2

| Condition | Flow rate (Q; l/min) | Diameter (mm) | The number of holes of first spray nozzle | Speed (V; m/s) |
|---|---|---|---|---|
| 1. Flow speed of gas | 28 | 20 | 1 | 1.486 |
| 2. Flow speed of gas | 28 | 20 | 3 | 0.495 |
| 3. Flow speed of gas | 28 | 20 | 6 | 0.248 |

<Speed of Gas>

Further, the number and size of air bubbles contained in an air bubble mixture 3 formed using the device for adjusting the number and size of air bubbles according to the present invention depending on the number of holes formed in the first spray nozzle 121 are changed as illustrated in the following [Table 3] and FIG. 5.

Here, in FIG. 5, the term "mean" indicates an average diameter of air bubbles contained in the air bubble mixture 3, the term "mode" indicates an effective average diameter of the most frequent air bubble, and the term "SD" indicates a standard deviation.

TABLE 3

| Experiment No. | Length of air bubble fining part (mm) (The number of units coupled to each other) | Diameter of inlet of first spray nozzle (mm) | The number of hole of first spray nozzle (n) | Bubbling Time (h) | Average diameter of air bubble (mm) | Effective average diameter of most frequent air bubble (nm) | Standard deviation (nm) | Concentration ($10^8$ particles/ml) |
|---|---|---|---|---|---|---|---|---|
| 1 | 390 (4 ea) | 20 | 1 | 0.5 | 165 | 133 | 64 | 3.82 |
| 2 | 390 (4 ea) | 20 | 3 | 0.5 | 134 | 125 | 48 | 1.45 |
| 3 | 390 (4 ea) | 20 | 6 | 0.5 | 93 | 89 | 32 | 2.98 |

<The Number and Size of Air Bubbles Contained in Air Bubble Mixture Depending on Increase in Number of Holes of Spray Nozzle>

That is, as the number of holes of the first spray nozzle 121 is increased, the average size of the air bubbles, the effective average diameter of the most frequent air bubble, and the standard deviation are decreased, but the number of air bubbles is increased.

Therefore, although not illustrated, the number and size of air bubbles contained in a finally formed air bubble mixture 3 may be controlled by controlling the number and size of effective holes formed in the first spray nozzle using various methods, for example, a method of controlling the number of effective holes through which the gas may pass by being closely coupled to a plate of which a surface is partially opened or provided with holes to the first spray nozzle 121 and rotating the surface of the plate contacting the first spray nozzle 121, a method of controlling the number and size of effective holes by attaching a stop controlling the size of the holes to the first spray nozzle 121, and the like, in order to adjust the number and size of holes formed in the first spray nozzle 121.

Figure 6:
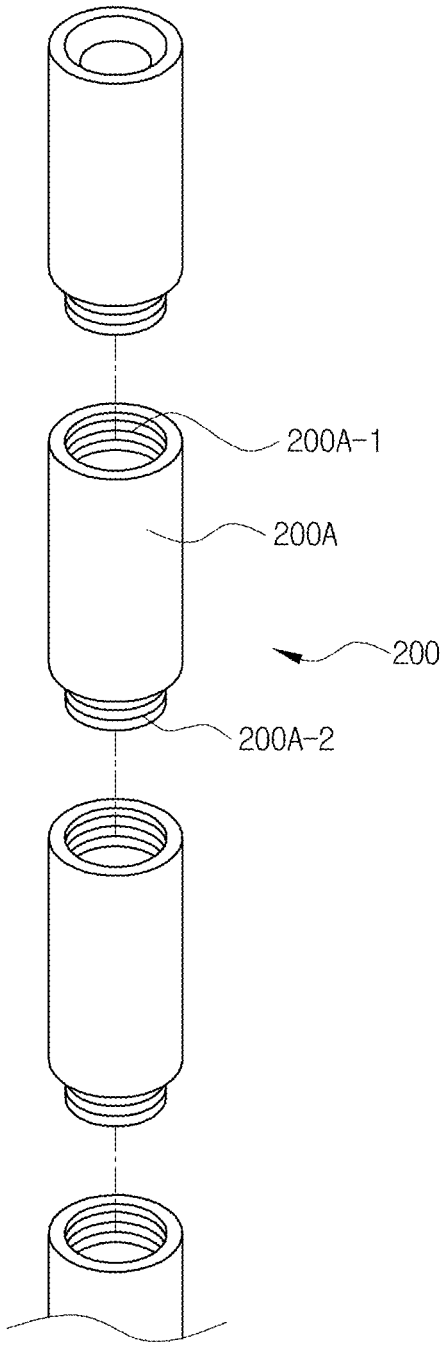
FIG. 6 is an assembled view illustrating an air bubble fining part of the device for adjusting the number and size of air bubbles (at the time of coupling units to each other).

Further, referring to FIG. 6, the air bubble mixture 3 formed in the gas mixing part 100 is introduced into the air bubble fining part 200 and collides with the first protrusion 210 to thereby drop, such that the air bubbles 2 contained in the air bubble mixture 3 is forcibly crushed, thereby increasing the number of air bubbles and decreasing the size of the air bubbles. That is, the number and size of air bubbles contained in the air bubble mixture 3 are controlled by controlling the length of the air bubble fining part 200.

Therefore, in order to easily control the length of the air bubble fining part 200, the air bubble fining part 200 is composed of a plurality of units 200A coupled to each other in the axial direction.

In detail, each of the units 200A has a structure in which a coupling groove 200A-1 is formed at one end portion of the unit 200A in the axial direction, a protrusion part 200A-2 corresponding to the coupling groove 200A-1 is formed at the other end portion thereof, and the coupling groove 200A-1 and the protrusion part 200A-2 adjacent to each other are coupled to each other, such that each of the units 200A is connected to each other.

In this case, a method of coupling the coupling groove 200A-1 and the protrusion part 200A-2 may be various. However, in order to minimize a leakage of the air bubble mixture through a connection portion of each of the units 200A, a method of forming a female screw thread in an inner surface of the coupling groove 200A-1 and forming a male screw thread in an outer surface of the protrusion part 200A-2 to form a rotation coupling structure may be recommended.

In addition, the number and size of air bubbles contained in the air bubble mixture 3 formed using the device for adjusting the number and size of air bubbles according to the present invention depending the number or length of coupled units 200A are changed as illustrated in the following [Table 4] and FIG. 7.

Further, the device for adjusting the number and size of air bubbles according to the present invention may control of the number and size of air bubbles contained in the air bubble mixture 3 by performing a circulation process of allowing the air bubble mixture 3 passing through the air bubble fining part 200 and discharged through the expanded pipe part 300 to be re-introduced into the gas mixing part 100.

Referring to FIG. 3, the air bubble mixture 3 discharged from the air bubble fining part 200 passes through the expanded pipe part 300 to thereby be introduced into a storage tank 400. In this case, the expanded pipe part 300 is formed to have the tapered structure in which an inner channel through which the air bubble mixture 3 passes is widened downwardly from the air bubble fining part 200 coupled to an upper portion thereof, and the air bubble mixture 3 passed through the expanded pipe part 300 drops into a water surface of the storage tank 400 while being dispersed thereinto. That is, the air bubble mixture 3 additionally has a chance of contacting air while being dispersed and dropped into the water surface of the storage tank 400, thereby further decreasing the size of the air bubbles contained therein and increasing the number of air bubbles.

In addition, a measurement sensor 410 for measuring the number and size of air bubbles contained in the air bubble mixture 3 is provided in the storage tank 400, thereby measuring the number and size of air bubbles contained in the air bubble mixture 3.

Further, when the number and size of air bubbles contained in the air bubble mixture 3 do not reach the desired values, the air bubble mixture 3 discharged from the air bubble fining part 200 is re-introduced into the gas mixing part 100 through a pipe 700 instead of the liquid 1.

In addition, the pipe 700 may be provided with a pump 500 in order to move the air bubble mixture 3 stored in the storage tank 400 to the liquid introduction part 110, and the pump 500 may receive a driving command from a control part 600 linked with the measurement sensor 410.

More specifically, when the number and size of air bubbles contained in the air bubble mixture 3, measured in the measurement sensor 410, do not reach the desired values, the control part 600 continuously operates the pump 500 to introduce the air bubble mixture 3 into the liquid introduction part 110, thereby circulating the air bubble mixture 3.

In this case, since the liquid 1 introduced from the liquid introduction part 110 into the gas mixing part 100 is replaced by the air bubble mixture 3 during a process of circulating

TABLE 4

| Experiment No. | Length of air bubble fining part (mm) (The number of units coupled to each other) | Diameter of inlet of first spray nozzle (mm) | The number of hole of first spray nozzle (n) | Bubbling time (h) | Average diameter of air bubble (nm) | Effective average diameter of most frequent air bubble (nm) | Standard deviation (nm) | Concentration ($10^8$ particles/ml) |
|---|---|---|---|---|---|---|---|---|
| Blank | | No experiment | | | 139 | 79 | 66 | 0.1 |
| 1 | 90 (1 ea) | 20 | 1 | 0.5 | 190 | 193 | 56 | 0.45 |
| 2 | 180 (2 ea) | 20 | 1 | 0.5 | 171 | 150 | 52 | 1.34 |
| 3 | 270 (3 ea) | 20 | 1 | 0.5 | 185 | 91 | 79 | 1.26 |
| 4 | 390 (4 ea) | 20 | 1 | 0.5 | 151 | 59 | 84 | 1.75 |

<The Number and Size of Air Bubbles Contained in Air Bubble Mixture Depending on Change in Length of Air Bubble Fining Part>

That is, as the length of the air bubble fining part is increased, the average size of the air bubbles and the effective average diameter of the most frequent air bubble tend to be decreased, but the number of air bubbles tends to be increased.

the air bubble mixture 3, the liquid 1 introduced from the outside to the liquid introduction part 110 is blocked by a valve 111.

In addition, the number and size of air bubbles contained in the air bubble mixture 3 formed using the device for adjusting the number and size of air bubbles according to the present invention depending on changes in circulation time of the air bubble mixture 3 and length of the gas mixing part 100 are changed as illustrated in the following [Table 5] and FIG. 8.

TABLE 5

| Experiment No. | Length of air bubble fining part (mm) (The number of units coupled to each other) | Diameter of inlet of first spray nozzle (mm) | The number of hole of first spray nozzle (n) | Circulation time (h) | Average diameter of air bubble (nm) | Effective average diameter of most frequent air bubble (nm) | Standard deviation (nm) | Concentration ($10^8$ particles/ml) | Remarks |
|---|---|---|---|---|---|---|---|---|---|
| 1 | 390 (4 ea) | 20 | 1 | 0.5 | 151 | 109 | 84 | 1.75 | |
| 2 | 390 (4 ea) | 20 | 1 | 1 | 122 | 121 | 42 | 3.52 | |
| 3 | 390 (4 ea) | 20 | 1 | 2 | 130 | 91 | 71 | 4.53 | |
| 4 | 390 (4 ea) | 20 | 1 | 4 | 116 | 65 | 55 | 4.21 | |
| 5 | 390 (4 ea) | 20 | 1 | 0.5 | 89 | 67 | 42 | 2.54 | Two gas |
| 6 | 390 (4 ea) | 20 | 1 | 1 | 85 | 55 | 48 | 4.54 | mixing |
| 7 | 390 (4 ea) | 20 | 1 | 2 | 99 | 80 | 51 | 6.53 | parts (4 h) + |
| 8 | 390 (4 ea) | 20 | 1 | 4 | 107 | 73 | 52 | 7.62 | one gas |
| 9 | 390 (4 ea) | 20 | 1 | 14 | 95 | 82 | 49 | 1.94 | mixing part (10 h) |

<The Number and Size of Air Bubbles Contained in Air Bubble Mixture Depending on Change in Circulation Time of Air Bubble Mixture and Length of Gas Mixing Part>

Figure 9:
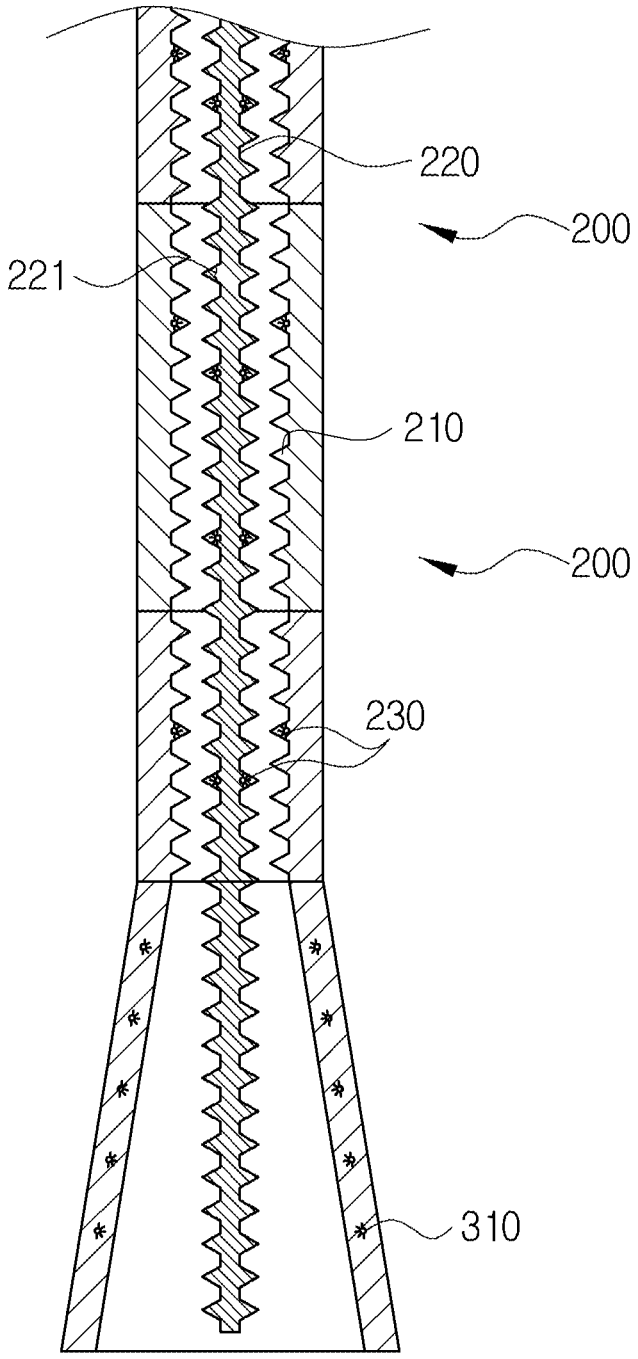
FIG. 9 is a cross-sectional view illustrating the air bubble fining part and an expanded pipe part of the device for adjusting the number and size of air bubbles (at the time of providing an air bubble crushing bar.

FIG. 9 illustrates an example of the device for adjusting the number and size of air bubbles according to the present invention, further including an air bubble crushing bar 220 provided at the center of the air bubble fining part 200 in the axial direction.

That is, a plurality of second protrusions 221 formed on an outer surface of the air bubble crushing bar 220 are formed alternately with the first protrusions 210.

In detail, since the size of the air bubbles 2 contained in the air bubble mixture 3 is decreased due to collision of the air bubble mixture 3 introduced from the gas mixing part 100 with the first protrusion 210, as a collision frequency of the air bubble mixture 3 with the first protrusion 210 is increased while the air bubble mixture 3 passes through the air bubble fining part 200, the size of the air bubbles 2 contained in the air bubble mixture 3 is decreased.

However, in the case of decreasing a spaced distance between the first protrusions 210 formed on the inner surface of the air bubble fining part 200 in order to increase a contact frequency of the air bubble mixture 3 passing through the air bubble fining part 200 with the first protrusion 210, a cross-sectional area of a path through which the air bubble mixture 3 passes is decreased in a circumferential direction, such that the flow rate of the air bubble mixture 3 capable of passing through the air bubble fining part 200 is decreased.

Therefore, the air bubble crushing bar 220 is fixed at the center of the air bubble fining part 200 in the axial direction, such that a spaced distance between each of the protrusions 210 and 221 may be minimized in a state in which the cross-sectional area of the path through which the air bubble mixture 3 passes is maintained as it is. In addition, the first and second protrusions 210 and 221 are positioned to be misaligned with each other, thereby causing an organic chain reaction that the air bubble mixture 3 colliding with the first protrusion 210 to thereby be scattered collides with the second protrusion 221 again.

In this case, it is recommended that ultrasonic wave generating parts 230 and 310 are further provided in the air bubble fining part 200 and the expanded pipe part 300, respectively, to emit the ultrasonic waves to the air bubble mixture 3 passing through the air bubble fining part 200 and the expanded pipe part 300, thereby inducing artificial destruction of unstable air bubbles contained in the air bubble mixture 3, allowing the size of air bubbles 2 contained in the air bubble mixture 3 to be decreased and be uniform, and increasing the number of air bubbles contained in the air bubble mixture 3.

Hereinafter, the method for adjusting the number and size of air bubbles according to the present invention will be described with reference to FIG. 10.

Figure 10:
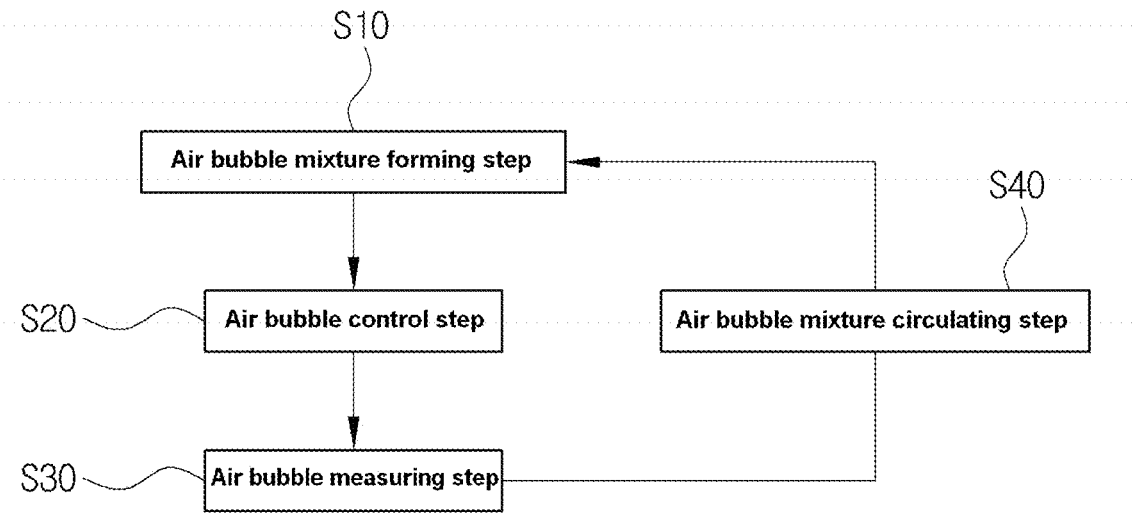
FIG. 10 is a flow chart illustrating a method for adjusting the number and size of air bubbles.

Referring to FIG. 10, in the method for adjusting the number and size of air bubbles, first, an air bubble mixture forming step (S10) of mixing a liquid 1 and gas 2 to form an air bubble mixture 3 is performed.

In addition, an air bubble controlling step (S20) of introducing the air bubble mixture 3 into an air bubble fining part 200 including protrusions 210 formed on an inner surface thereof to control the number and size of air bubbles contained in the air bubble mixture 3 is performed.

In this case, since in the air bubble controlling step (S20), the size of air bubbles 2 contained in the air bubble mixture 3 is decreased by allowing the air bubble mixture 3 to collide with the first protrusion 210 formed on the inner surface of the air bubble fining part 200, it is possible to adjust a length of the air bubble fining part 200 to control the size of air bubbles 2 contained in the air bubble mixture 3.

Thereafter, an air bubble measuring step (S30) of measuring the number and size of air bubbles contained in the air bubble mixture 3 discharged from the air bubble fining part 200 is performed.

Referring to FIG. 3, the air bubble mixture 3 discharged from the air bubble fining part 200 passes through the expanded pipe part 300 to thereby be introduced into a storage tank 400.

In addition, a measurement sensor 410 for measuring the number and size of air bubbles contained in the air bubble mixture 3 is provided in the storage tank 400, thereby measuring the number and size of air bubbles contained in the air bubble mixture 3.

Further, when the number and size of air bubbles contained in the air bubble mixture 3 do not reach the desired values, an air bubble mixture circulating step (S40) of replacing the liquid 1 with the air bubble mixture 3 discharged from the air bubble fining part 200 to repeat the air bubble mixture forming step (S10), the air bubble controlling step (S20), and the air bubble measuring step (S30) is further performed.

Hereinafter, gas 2 contained in the air bubble mixture 3 is defined as "air bubble", and various Application Examples using the device and the method for adjusting the number and size of air bubbles according to the present invention will be described.

In various industrial fields, a technology of dissolving gas in a liquid at a high concentration, or a technology of remaining, destroying, or floating gas as air bubbles has been applied.

Particularly, in a food field, gas such as carbon dioxide, or the like, is dissolved or allowed to remain in drinking water to thereby be utilized as a functional drink, or the like, and in a semiconductor manufacturing field, air bubbles have been used to wash a surface of a semiconductor by allowing the air bubbles bubbled in a liquid to be destroyed on an etching surface of the semiconductor. Further, in an environmental field, air bubbles having levitation power have been utilized in order to remove floating materials in waste water. A technology capable of mass-producing air bubbles having a size suitable for purpose has been required in order to utilize the air bubbles for the above purpose such as remaining, destructing, or floating, or the like, as described above.

Observing air bubbles formed in an bubbler of an aquarium for farming aquarium fishes or fishes, an air bubble having a notably large size rapidly floats on water to thereby be dispersed in the air, but a small air bubble may move in a horizontal direction, even remain at a bottom of the aquarium over a long period of time, or also slowly float to thereby be destroyed and disappear in the water.

As described above, since specific gravity of the air bubble is smaller than that of water, basically, the air bubble naturally floats due to buoyancy, but air bubbles may not float depending on the size and surface characteristics of the air bubbles. As a factor associated with the above-mentioned phenomenon, since significantly various physicochemical and electrostatic forces capable of changing a vertical floating direction of buoyancy, for example, brown movement occurring in water, repulsive force between the air bubbles by surface charges of the air bubbles, hydrogen bonds between water molecules, dipole moment, van der waals force, interfacial force in a water-air bubble interface, a concentration of impurities or solutes in water and surface charges thereof, or more comprehensive force, that is, convection caused by a temperature difference, a density difference, or the like, flow by external impact, gas diffusion in the liquid, and the like, are present outside the air bubbles, an air bubble having a sufficiently small size may remain in the water over a long period of time.

Therefore, the device and method for adjusting the number and size of air bubbles according to the present invent may mass-produce air bubbles having a size of several ten nano meters to several hundred micro meters so as to allow size distribution to be constant and allow the number of air bubbles to be suitable for purposes as in the following Application Examples to be described below, such that the device and method for adjusting the number and size of air bubbles may be efficiently and economically utilized in a food field, an industrial field, an environmental field, a biology field, a medical field, and the like.

Figure 11:
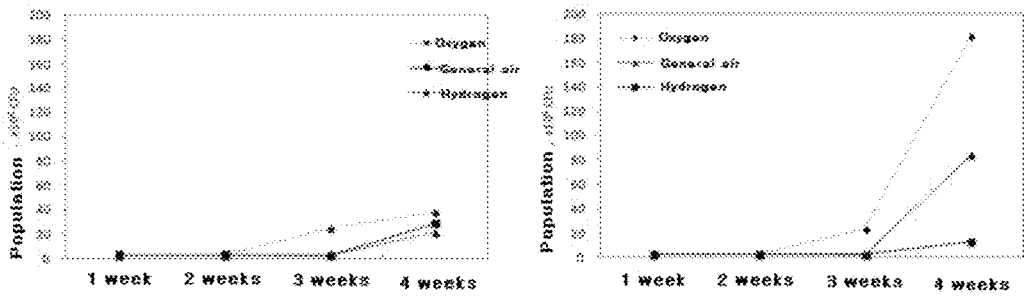
FIG. 11 illustrates Application Example 1 using the device for adjusting the number and size of air bubbles (a change in population of *Aspergillus* strains depending on a storage temperature and a storage time of Makgeolli (raw rice wine) and the kind of bubbling gas).

[Application Example 1] Fermentation Promotion or Suppression Effect Using Oxygen or Hydrogen Gas Air Bubble Referring to FIG. 11, 30% vol. of water containing oxygen or hydrogen gas air bubbles was added to raw makgeolli (rice wine), which is one of fermented foods, after a stabilizing period (about 3 weeks), and a proliferation state of *Aspergillus oryzae* (makgeolli fermentation fungi) was observed for 4 weeks under cold storage condition (4° C.) and room-temperature storage condition (20° C.). The number of *Aspergillus oryzae* tended to increase in oxygen water added makgeolli under the room-temperature storage condition (20° C.) as compared to un-treated makgeolli, but proliferation of *Aspergillus oryzae* was clearly suppressed in the case of adding hydrogen water. In the case of cold storage (4° C.), there was no large change in all makgeolli samples during the observation time. In the case of using the effect of improving or suppressing proliferation of oxygen or hydrogen gas on yeast, fermentation fungi, or the like, it is possible to decrease a fermentation period of food or extend an expiration date of food. Further, gas such as hydrogen, oxygen, carbon dioxide, or the like, a health improving additive, or the like, may be dissolved or allowed to remain in drinking water to thereby be utilized as a functional drink, a health assistance, or the like.

Figure 12:
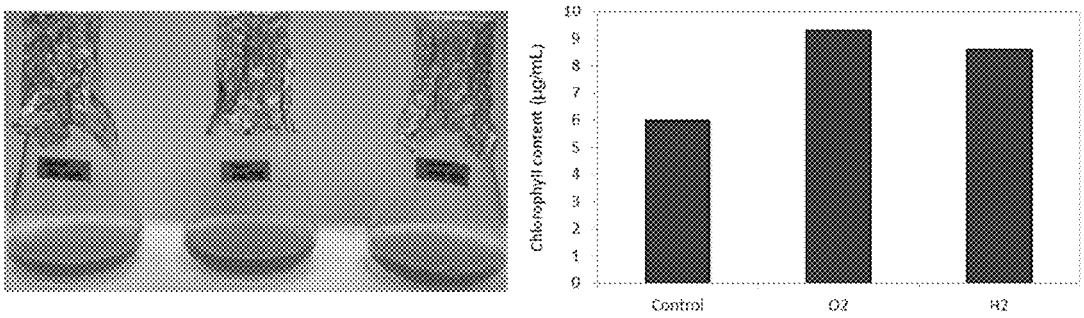
FIG. 12 illustrates Application Example 2 using the device for adjusting the number and size of air bubbles (comparison of chlorophyll content in general water, oxygen water, and hydrogen water depending on culture solution).

[Application Example 2] Microalgae Culturing Effect of Oxygen Water or Hydrogen Water Referring to FIG. 12, among microalgae, *Nannochloropsis oculata* (*N. oculata*) and *Chlorella vulgaris* (*C. vulgaris*) have been known as important resources capable of producing bio-diesel. In order to observe an influence of culture water in which a content of oxygen or hydrogen is higher than that of general culture water on growth of microalgae, these microalgae were cultured in a medium prepared using oxygen water or hydrogen water, among various evaluation factors, contents of chlorophyll and carotinoid produced by photosynthesis of the microalgae were measured. Chlorophyll has been known as an energy source of organism growth, and carotinoid has been known as an antioxidant material.

As an experimental result, in the case in which *N. oculata* was cultured in oxygen water and hydrogen water, the content of chlorophyll was increased by about 54% and 30% and the content of carotinoid was increased by 21% and 25%, respectively, as compared to a control group. In the case of *C. vulgaris*, the content of chlorophyll was increased in oxygen water and hydrogen water by about 59% and 39% and the content of carotinoid was also increased by 49% and 29%, respectively, as compared to a control group.

From the result as described above, it is expected that a similar effect may be obtained in farming marine products in addition to culturing green algae for fuel converting as in the present Application Example, and various algae cultured by the method as described above may also be utilized as substitute food for humans or feed for livestock.

Figure 13:
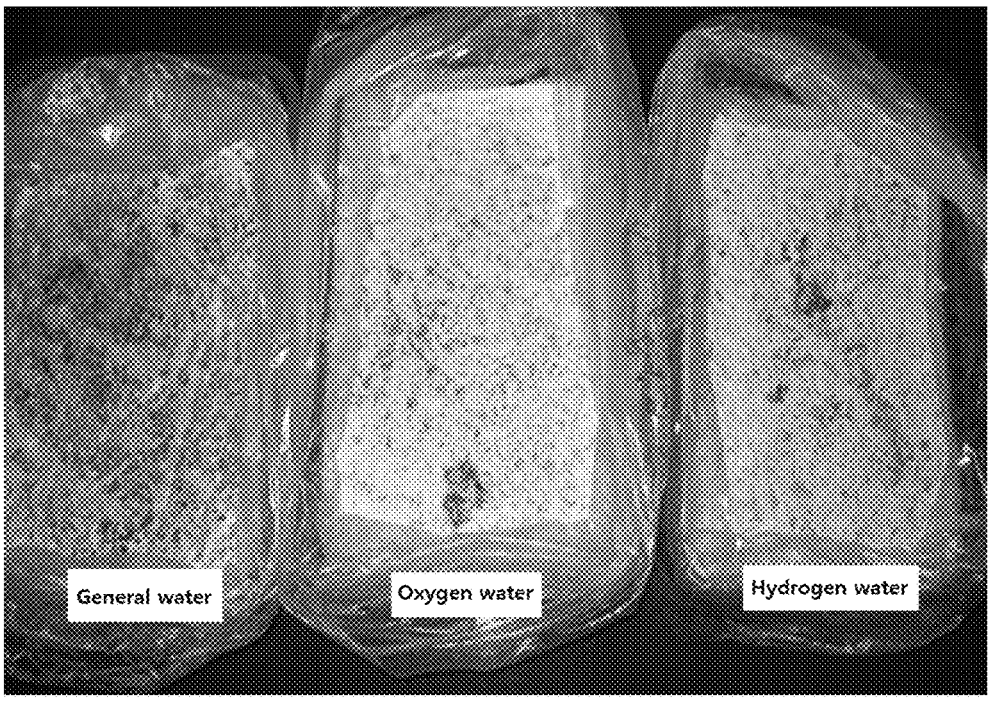
FIG. 13 illustrates Application Example 3 using the device for adjusting the number and size of air bubbles (influence of oxygen water and hydrogen water on growth rate of mushroom mycelium).

[Application Example 3] Influences of Oxygen Water and Hydrogen Water on Growth Rate of Mushroom Mycelium Referring to FIG. 13, growth rates of mushroom mycelium using existing general water, oxygen water, and hydrogen water as a culture solution, respectively, in a sawdust culture medium for culturing whangtosongi mushroom mycelium cultured based on a trial experiment in order to develop a mass-production technique were compared. In the cases of using the oxygen water and the hydrogen water as the culture solution, the growth rate was high as compared to the general water, and the growth rate in oxygen water was slightly higher that than in hydrogen water. It is judged that in the case of applying the result as described above to other plants, livestock, or the like, oxygen water and hydrogen water may contribute to increasing functional food and food production amounts due to increases in active ingredients and growth rate.

[Application Example 4] Sterilization Effect of Oxygen Water and Hydrogen Water

Referring to FIG. 14, in order to confirm appropriateness of oxygen water and hydrogen water containing air bubbles as raw materials for cosmetics, antiseptic activities, that is, sterilization effects of oxygen water and hydrogen water were confirmed. After $2.0\times10^8$ CFU of fungi (*Aspergillus niger, Candida albicans*) and $6.6\times10^8$ CFU of general bacteria (*Pseudomonas aeruginosa, Escherichia coli, Staphylococcus aureus*) were each inoculated in 1 g of oxygen water and 1 g of hydrogen water after about 5 days from preparation, respectively, population variations of inoculated strains were observed after 3 days from inoculation and every week thereafter for a total of 4 weeks. In this experiment, in general water, the population of the strains tended to increase with the passage of time. On the contrary, in the oxygen water and the hydrogen water, the population of the strains tended to decrease for about 3 weeks, but increase after 3 weeks.

In the experiment, the fungi which patients with weak immunity or administered with antibiotics or steroid were frequently infected were clearly killed immediately after inoculation, and the general bacteria were also killed for 2 to 3 weeks from inoculation. The results of the experiment were illustrated in FIG. 14.

From this experiment, it may be judged that unstable air bubbles were destroyed in the air bubble water containing air bubbles during a certain period depending on preparation or storage conditions, a sterilization effect on pathogenic microbes was exhibited in this process, and after this period, the sterilization effect was lost, but air bubbles contributed to increasing a dissolved oxygen rate or dissolved hydrogen rate while remaining as stable air bubbles. Therefore, in the case of preparing air bubble water mainly containing unstable air bubbles, the air bubble water may be used instead of a chemical germicide in a cooking kitchen for mass food production, and may also be used as a disinfectant for preventing the spread of avian influenza or foot-and-mouth disease. Further, it is predicted that the air bubble water may be used in bath water or a therapeutic adjuvant for a sickly person or a patient, a humidifier supplement solution, which is at issue due to addition of toxic chemicals, a contact lens washing solution, or be combined with other technologies to be used in removing scales in pipes.

[Application Example 5] Influence on Green Algae and Ecological Environment

Referring to FIG. 15, in 2013, oxygen water was directly injected into a pond in Soonchang cold water amusement park of which an average depth was about 1 m, and an entire flow rate was about 100 $m^3$ (Soonchang-gun, Jeonbuk, Korea) from August to December at which proliferation of algae (green algae) is seasonally active, using an apparatus of generating air bubbles, operated according to the principle as described above. The pond to be tested was composed of a total of 5 artificial ponds, and an oval pond (length: about 20 m, width: about 10 m) in which water introduced from neighboring small rivers finally remained was set as a test pond for observing an oxygen bubbling effect, and a middle pond (length: about 6 m, width: about 3 m) in the same stream was set as a control pond. During an experiment period, sampling was performed and water quality was analyzed twice a month, and the presence or absence of death of algae due to an ecological environment improvement effect and an air bubble destruction effect of dissolved oxygen was observed.

Water quality analysis categories for evaluating the effects were chemical oxygen demand (COD), total nitrogen (T-N), ammonia nitrogen (NH3-N), nitrite nitrogen (NO2-N), nitrate nitrogen (NO3-N), total phosphorus (T-P), phosphate phosphorus (PO4-P), the number and size of air bubbles, dissolved oxygen concentration, and the like, and destructive coarse air bubbles having a size of about 20 μm and residual fine air bubbles (average size: 123 nm, $7.75\times10^8$ ea/cc, FIG. 16) having a size of about 0.12 μm were alternately generated. Then, influences thereof were observed. Since it was difficult to directly count the population of the algae, the population of the algae was evaluated by turbidity from which a concentration of floating materials may be measured.

As an experimental result, the population of the algae evaluated by turbidity was about 30% of that of the control pond as illustrated in the following FIG. 15, such that the population of the algae was clearly decreased, which may be caused by an algae killing effect due to air bubble destruction. Further, the dissolved oxygen concentration measured in the control pond was about 5 ppm, and the dissolved oxygen concentration measured in the test pond was about 10 ppm, such that a residual effect of oxygen gas was clearly exhibited. The high-concentration dissolved oxygen may provide an environment in which water plants or living organism such as fishes, or the like, may be fully active, thereby allowing these aquatic organisms to eat the green algae. Therefore, indirectly, the green algae may be naturally removed. Further, it was observed that among the algae, both green algae and diatoms live in the control pond, but in the test pond, only the green algae were observed. Emergency times, environmental influences, and the like, of the two kinds of algae were similar to each other, but it was known that the diatoms have a fast division rate (0.5 to 2 days/once), a wide acidity (pH 1.2 to 11), and salt concentration corresponding to 3 times that of sea water, and inhabit easily in a specific and extreme environment such as hot spring water (40° C.) and ice in the Arctic. In the test pond and control pond, COD, T-N, NH3-N, NO2-N, NO3-N, T-P, and the like, except for the turbidity and the dissolved oxygen concentration were similar to each other. The results were illustrated in <Comparison of water quality in control pond and test pond> of FIG. 15. Here, experimental values represented by "green algae concentration" (right portion of FIG. 15) are average values of turbidities of respective samples during the observation period.

From this experiment, it may be judged that there was no effect of removing phosphorus and nitrogen known as nutrient sources of the algae, but it was possible to remove the generated algae or suppress proliferation of the algae to some degree.

Figure 18A:
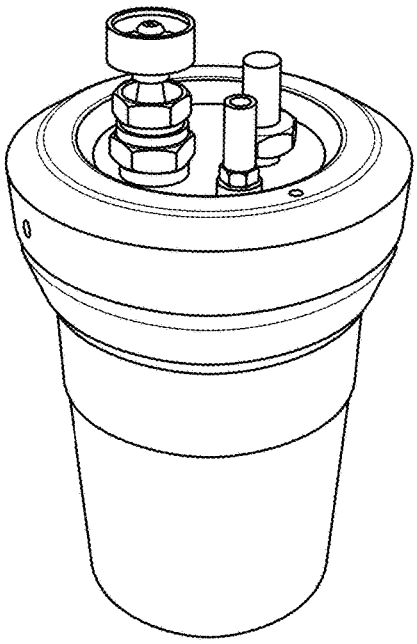
Figure 18B:
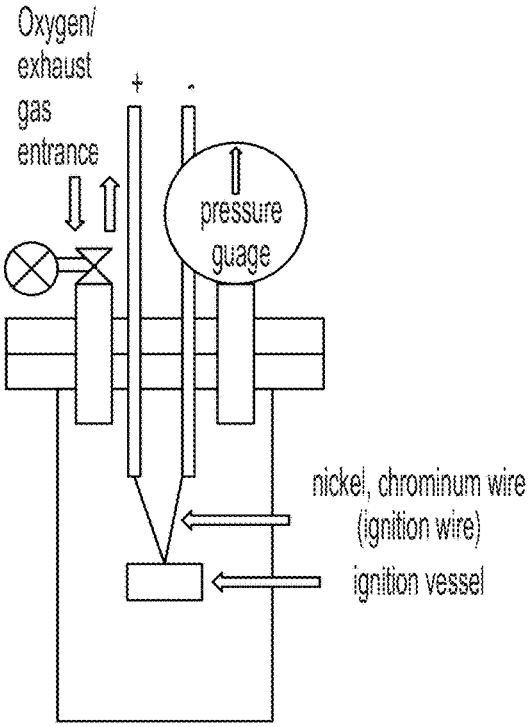

[Application Example 6] Influence of Oxygen Bubble Mixed Fuel Oil and Hydrogen Bubble Mixed Fuel Oil on Degree of Combustion Referring to the following Table 6 and FIGS. 17 and 18, oxygen gas and hydrogen gas were bubbled in automotive diesel for 20 minutes, respectively, using a device operated according to the principle as described above, an amount of combustion residues and calorific value were compared with those of untreated fuel oil. In the case of the prepared oxygen bubble mixed diesel, an average size of air bubbles was 141 nm, and the number of air bubbles was $5.85\times10^8$ ea/ml as illustrated in FIG. 17.

Combustion residues were measured using the following device (FIG. 18). This device, which may measure an amount of the combustion residues remaining after combustion of the fuel in an oxy-fuel combustion environment, may evaluate combustion efficiency. For the experiment, after putting untreated diesel (0.5 g) and oxygen or hydrogen bubble mixed fuel oil (0.5 g) in a cylindrical ignition vessel (diameter: 2.5 cm), fixing the cylindrical ignition vessel to a lower end of an internal portion of the device, and closing the device, the device was filled with oxygen of 30 atm. (purity: 99.99%). Then, the fuel was ignited with an electrical spark and then combusted. Since an amount of the combustion residues was significantly small when the combustion was performed once, after the combustion was cumulatively performed a total of 10 times, and a weight of the accumulated residue was measured and evaluated.

The experimental results obtained by measuring the combustion residues were illustrated in Table 6. In the case of untreated diesel, an amount of combustion residues accumulated 10 times was about 0.0609 g, in the case of oxygen bubble mixed diesel, the amount was about 0.0541 g, and in the case of hydrogen bubble mixed diesel, the amount was about 0.0496 g, such that the residues were decreased by 18.6% in the hydrogen bubble mixed diesel, and decreased by 11.2% in the oxygen bubble mixed diesel, as compared to the untreated general oil. From this experiment, a decrease in soot of fuel gas in addition to an increase in degree of combustion of the air bubble mixed fuel oil was predicted.

Further, at the time of measuring the calorific value, a calorific value of the untreated general diesel was about 10,348 cal/g, a calorific value of the oxygen bubble mixed diesel was about 10,468 cal/g, and a calorific value of the hydrogen bubble mixed diesel was about 10,631 cal/g, such that the calorific values of the oxygen bubble mixed fuel oil and the hydrogen bubble mixed fuel oil were increased by about 1.2% and 2.7%, respectively, as compared to the untreated general diesel. Therefore, it was predicted that fuel efficiency will be increased.

In the case of applying the oxygen bubble and the hydrogen bubble to heating oil, agricultural oil, industrial oil, or the like, as well as all kinds of fuel oil, the same effect as described above may be obtained.

TABLE 6

| Experiment | General oil | $O_2$ bubble mixed oil | $H_2$ bubble mixed oil |
|---|---|---|---|
| 1st | 0.0058 | 0.0052 | 0.0052 |
| 2nd | 0.0114 | 0.0102 | 0.0101 |
| 3rd | 0.0172 | 0.0159 | 0.0153 |
| 4th | 0.0234 | 0.0203 | 0.0199 |
| 5th | 0.0299 | 0.0267 | 0.0256 |
| 6th | 0.0368 | 0.0321 | 0.0302 |

TABLE 6-continued

| Experiment | General oil | $O_2$ bubble mixed oil | $H_2$ bubble mixed oil |
|---|---|---|---|
| 7th | 0.0420 | 0.0377 | 0.0354 |
| 8th | 0.0481 | 0.0429 | 0.0407 |
| 9th | 0.0543 | 0.0485 | 0.0450 |
| 10th (finally accumulated amount, g) | 0.0609 | 0.0541 | 0.0496 |

<Amount of Combustion Residues Depending on the Kind of Gas Bubbled in Diesel>

In the device and the method for adjusting the number and size of air bubbles according to the present invention, the gas mixing part 100 having a diameter corresponding to 2 to 3 times of that of the liquid supply pipe is provided, such that a mixing space for allowing the supplied liquid and gas to be efficiently mixed therein is provided. In addition, the gas mixing part 100 has the tapered shape, in which the cross-sectional area thereof is decreased from the upper portion thereof toward the lower portion thereof, and has a predetermined angle so that the air bubble mixture passing through an end portion of the gas mixing part 100 connected to the air bubble fining part 200 may rapidly pass through the device without resistance. Further, a relative flow speed of each of the liquid and the gas introduced into the mixing space may be adjusted, thereby making it possible to adjust a size of the primarily formed air bubbles to be fine or coarse.

In order to fine the air bubbles or increase the number of air bubbles in the air bubble mixture, the protrusions are installed on the inner surface of the air bubble fining part. In addition, the air bubble mixture may be allowed to intensely or softly collide with the protrusion by adjusting the flow speed of the air bubble mixture passing through the air bubble fining part having the protrusion as described above, such that the number of air bubbles may be increased by fining coarse air bubbles contained in the air bubble mixture, or the increase in the number of air bubbles may be suppressed. Further, in order to maximize the fining of the air bubble within a short time, the air bubble crushing bar is additionally installed at the center in the axial direction. In this case, the number and size of air bubbles may be more efficiently adjusted by changing shapes and roughness of the protrusion, an alternating position with peripheral protrusions, or the like, depending on purpose.

The air bubble mixture, in which the air bubbles are fined and the number of air bubbles is increased, while the air bubble mixture passing through the air bubble fining part, passes through the expanded pipe part, which is a distal end part of the device. The expanded pipe part has a shape in which a distal end thereof is expanded in a trumpet shape, and may allow the air bubble mixture to be dispersedly dropped on the water surface of the storage tank, thereby making it possible to exclude a case in which the size of the air bubbles is increased due to coupling between the air bubbles when the air bubble mixture centrally drops at one position.

Further, the gas mixing part, the air bubble fining part, and the like, may be composed to be prefabricated so that the lengths thereof may be adjusted, thereby making it possible to prepare the air bubble mixture or air bubble water in which air bubbles having a size suitable for applicable purposes are contained.

In addition, the device is configured so that a process of controlling the number and size of air bubbles contained in the air bubble mixture may be repeated or circulated, thereby making it possible to further fine the air bubble particles contained in the air bubble mixture.

The number and size of air bubbles contained in the air bubble mixture may be effectively adjusted using the device and method as described above, and since energy consumption is decreased as compared to the existing method, and an impeller rotating at a high speed is not used, the device and method as described above may have high work safety.

Therefore, unlike the device of generating air bubbles according to the related art, which produces the air bubble mixture in which it is impossible to adjust the number and size of air bubbles, and thus, is difficult to be applied to various industrial fields, the device and method according to the present invention may be applied to various industrial fields.

What is claimed is:

1. A device for adjusting a number and size of air bubbles comprising:

a gas mixing part in which a liquid and a gas are mixed with each other to form an air bubble mixture;

an air bubble fining part coupled to a lower end of the gas mixing part, including a plurality of first protrusions formed on an inner surface thereof so that the air bubble mixture introduced from the gas mixing part collides therewith, and including an air bubble crushing bar at a center thereof in an axial direction;

an expanded pipe part formed on a lower end of the air bubble fining part and directly connected to the lower end of the air bubble fining part, and dispersing and discharging the air bubble mixture;

a liquid introduction part controlling a flow rate and a flow speed of the liquid into the gas mixing part;

a gas introduction part controlling a flow rate and a flow speed of the gas introduced into the gas mixing part; and a storage tank in which the air bubble mixture discharged from the expanded pipe part is stored and a measurement sensor measuring the number and size of air bubbles contained in the stored air bubble mixture is provided, wherein the expanded pipe part has a tapered shape in which an inner channel is widened from an upper portion thereof directly connected to the lower end of the air bubble fining part toward a lower portion thereof through which the air bubble mixture is discharged;

wherein a lower portion of the gas mixing part connected to the air bubble fining part is provided with an acceleration part, and the acceleration part has a tapered shape in which a width of an inner channel is decreased from an upper portion thereof toward a lower portion thereof; and wherein the storage tank is directly connected to the lower portion of the expanded pipe part.

2. The device for adjusting the number and size of air bubbles of claim 1, wherein an outer surface of the air bubble crushing bar is provided with a plurality of second protrusions.

3. The device for adjusting the number and size of air bubbles of claim 2, wherein the plurality of the second protrusions is alternated with the plurality of first protrusions.

4. The device for adjusting the number and size of air bubbles of claim 1, wherein the gas introduction part is provided with a first spray nozzle supplying the gas to the liquid introduced into the gas mixing part.

5. The device for adjusting the number and size of air bubbles of claim 1, further comprising:

a pump moving the air bubble mixture stored in the storage tank to the gas mixing part; and a control part linked with the measurement sensor to drive the pump.

6. The device for adjusting the number and size of air bubbles of claim 1, wherein the air bubble fining part comprises a plurality of units coupled to each other in an axial direction.

7. The device for adjusting the number and size of air bubbles of claim 2, wherein the air bubble fining part and the expanded pipe part further include ultrasonic wave generating parts and emitting ultrasonic waves to the air bubble mixture flowing therein, respectively.

8. The device for adjusting the number and size of air bubbles of claim 1, wherein a diameter of the gas mixing part is 2 to 3 times that of a liquid supply pipe through which the liquid is introduced into the gas mixing part, and a length of the gas mixing part is adjusted.

9. The device for adjusting the number and size of air bubbles of claim 4, wherein in the first spray nozzle, one or two or more holes are formed, and the flow rate and the flow speed of the gas introduced into the gas mixing part are controlled by adjusting the number of holes.

* * * * *